US007178244B2

(12) United States Patent
Fossella

(10) Patent No.: US 7,178,244 B2
(45) Date of Patent: Feb. 20, 2007

(54) POWERED UTILITY KNIFE

(75) Inventor: Gregory Fossella, Scituate, MA (US)

(73) Assignee: Avello LLC, Marshfield Hills, MA (US)

( * ) Notice: Subject to any disclaimer, the term of this patent is extended or adjusted under 35 U.S.C. 154(b) by 0 days.

(21) Appl. No.: 11/225,699

(22) Filed: Sep. 12, 2005

(65) Prior Publication Data

US 2006/0053631 A1 Mar. 16, 2006

Related U.S. Application Data

(60) Provisional application No. 60/616,698, filed on Oct. 7, 2004, provisional application No. 60/609,781, filed on Sep. 14, 2004.

(51) Int. Cl.
*B26B 1/08* (2006.01)
*B26B 7/00* (2006.01)

(52) U.S. Cl. ..... 30/162; 30/392

(58) Field of Classification Search ..... 30/392, 30/162, 272.1, 277.4
See application file for complete search history.

(56) References Cited

U.S. PATENT DOCUMENTS

| | | | | | |
|---|---|---|---|---|---|
| 2,337,769 | A | * | 12/1943 | Redenbo | 30/394 |
| 2,384,435 | A | * | 9/1945 | Bodine | 30/392 |
| 3,009,246 | A | | 11/1961 | Witherby | |
| 3,107,426 | A | * | 10/1963 | Robinson, Jr. | 30/162 |
| 3,192,624 | A | * | 7/1965 | Gringer | 30/162 |
| 3,283,407 | A | | 11/1966 | Bacon | |
| 3,303,563 | A | * | 2/1967 | Peterson | 30/277.4 |
| 3,307,259 | A | * | 3/1967 | Christensen | 30/277.4 |
| 3,314,148 | A | * | 4/1967 | Foellmi | 30/162 |
| 3,315,356 | A | | 4/1967 | Swanke et al. | |
| 3,316,636 | A | * | 5/1967 | Raper, Jr. et al. | 30/210 |
| 3,337,952 | A | | 8/1967 | Rosen | |
| 3,383,764 | A | | 5/1968 | Sachs | |
| 3,439,419 | A | * | 4/1969 | Fleming | 30/162 |
| 3,453,729 | A | * | 7/1969 | Larson | 30/162 |
| 3,491,279 | A | | 1/1970 | Rodaway | |
| 3,572,409 | A | * | 3/1971 | Hoffman | 30/371 |
| 3,664,021 | A | | 5/1972 | Sawyer | |
| 3,832,776 | A | | 9/1974 | Sawyer | |
| 3,872,591 | A | * | 3/1975 | Quenot | 30/162 |
| 4,242,795 | A | * | 1/1981 | Rollband et al. | 30/162 |
| 4,393,587 | A | * | 7/1983 | Kloosterman | 30/162 |

(Continued)

*Primary Examiner*—Kenneth E. Peterson
*Assistant Examiner*—Sean Michalski
(74) *Attorney, Agent, or Firm*—Fish & Richardson P.C.

(57) ABSTRACT

A powered utility knife has a housing defining a handle surface and an internal cavity. A shuttle plate assembly disposed for movement relative to the internal cavity, with a first surface in sliding engagement with an interior wall of the cavity includes a motor mounted to the shuttle plate and a blade carrier with a surface in sliding engagement with the shuttle plate. A drive assembly associated with the motor imparts effective cutting motion to a blade on the blade carrier. An activator protruding through a slot in the housing is configured for slidable translation along the slot to cause lateral movement of the shuttle plate assembly within the cavity. The blade, with the shuttle plate assembly in extended position, has a first portion protruding through a blade slot at the end of the housing, and with the shuttle plate assembly in retracted position, the blade is retracted within the cavity. A power source is connected to the motor, and a power switch is in communication between the power source and motor.

21 Claims, 46 Drawing Sheets

U.S. PATENT DOCUMENTS 4,644,653 A 2/1987 Bacon et al.
4,711,030 A 12/1987 Ruston, Sr.
4,771,542 A 9/1988 Beveridge
4,891,884 A * 1/1990 Torbet ..... 30/277.4
5,230,155 A * 7/1993 Pai ..... 30/277.4
5,337,482 A 8/1994 Schmidt
5,384,963 A 1/1995 Beermann
5,392,519 A 2/1995 Inoue et al.
5,511,912 A * 4/1996 Ellerbrock ..... 408/20
5,590,469 A 1/1997 Hoover et al.
5,778,541 A 7/1998 McClung
6,000,136 A * 12/1999 Owens ..... 30/162
6,021,573 A * 2/2000 Kikuchi et al. ..... 30/392
6,094,826 A * 8/2000 Schmidt ..... 30/369
6,341,425 B1 1/2002 Kahle
6,357,120 B1 * 3/2002 Khachatoorian et al. ..... 30/162
6,434,896 B1 8/2002 Mitchell
6,487,779 B1 12/2002 Underthun
6,546,632 B2 * 4/2003 Gilbert ..... 30/162
6,796,033 B2 * 9/2004 Owoc ..... 30/162
6,907,668 B2 * 6/2005 Polei ..... 30/162
6,976,313 B2 * 12/2005 Wong ..... 30/369
2002/0178589 A1 12/2002 Wong et al.
2003/0041464 A1 3/2003 Anders
2003/0150117 A1 * 8/2003 Owoc ..... 30/162
2003/0192191 A1 10/2003 Wong
2003/0192198 A1 10/2003 Wright et al.

* cited by examiner

POWERED UTILITY KNIFE

BACKGROUND

This application claims benefit from U.S. Provisional Patent Application No. 60/609,781, filed Sep. 14, 2004, now pending, and U.S. Provisional Patent Application No. 60/616,698, filed Oct. 7, 2004, now pending. The complete disclosures of both applications are incorporated herein by reference.

The present disclosure relates to powered utility knives.

A conventional manual utility knife typically includes an axially elongated housing or case that also serves as a handle, a blade holder moveably mounted in the case, and a blade mounted upon the blade holder. The blade holder may be fixed relative to the body by a spring-biased tab that can be disengaged to permit movement of the blade holder to extend the blade from the case, e.g. for cutting, and to retract the blade into the case, e.g. for safe storage. To replace a blade, the case is usually disassembled to allow the blade to be removed from the blade holder. A replacement blade, which may be stored in a cavity in the handle provided for that purpose, is installed on the blade holder, and the utility knife case is then reassembled.

SUMMARY

The present disclosure provides a powered utility knife.

The disclosure can be implemented to realize one or more of the following advantages.

The utility knife of the present disclosure has the benefit of motorized power that shuttles the blade back and forth rapidly for more efficient cutting of various materials commonly cut with manual utility knives. In addition, the power feature allows this utility knife to cut materials not previously feasible to be cut with a manual utility knife.

The motor of the disclosed utility knife can be powered by a combination of options, such as rechargeable or replaceable batteries or by an electrical corded connection. A battery or battery cartridge can be recharged while engaged with the knife housing or the battery cartridge can be removed for recharging while an alternate battery cartridge is engaged for used.

In one example, the blade of the disclosed utility knife can be extended beyond the knife housing and locked into one of a number of cutting positions. The blade can also be retracted so that the blade is fully contained within the knife housing to allow safe handling of the utility knife without risk of the user being cut. The extending and retracting of the blade is accomplished by moving an automatic locking activator located on the top of the knife housing axially, forward or backwards.

Some of the disclosed utility knives have a blade-change-door to expedite changing of blades. Power is "on" only while the operator is depressing the power switch, or when safety limit switches or other safety electrical disconnect circuits contained within the utility knives are not actuated, thus providing a multiplicity of concurrent safety features.

The power feature enables this utility knife to cut a greater variety of materials, including materials not feasible to cut, with a manual utility knife. A variety of blades with different cutting edges have also been designed for use with this utility knife to make further advantage of the power feature.

In another implementation, the disclosed powered utility knife has many of the features described above; however, the non-retractable blade is fixedly mounted to extend at the end of the housing. This implementation of the utility knife also has multiple concurrent safety features to protect against power being inadvertently activated during blade changing.

In another implementation, the disclosed utility knife has a blade powered in cutting motion by a vibrating motor. This utility knife has many of the features of the implementations described above. A non-retractable blade is fixedly mounted to extend at the end of the housing. The vibrating motor, secured to a fixed motor plate by a motor bracket assembly, causes the extended blade to vibrate in an effective cutting fashion.

In still another implementation, the disclosed utility knife includes a retractable motor plate and vibrating motor. The retractable motor plate allows manual retraction or extension of the blade relative to the knife housing. The vibrating motor, secured to the motor plate by a motor bracket assembly, causes the blade, when extended blade, to vibrate in an effective cutting fashion.

Utility knives described herein may also permit the blade to be reversed, allowing use, in turn, of both front and rear end segments of the cutting edge of a single blade.

DESCRIPTION OF THE DRAWINGS

FIGS. 54A to 57A are side plan views of implementations of utility knife blade carriers of the disclosure configured to receive utility knife blades having the configurations of FIGS. 54 to 57, respectively.

FIG. 58 is a side section view of another implementation of a powered utility knife of the disclosure, in which a fixed (non-retractable) blade is driven in a vibrating cutting action; while

Like reference numbers and designations in the various drawings indicate like elements.

DETAILED DESCRIPTION

Figure 1:
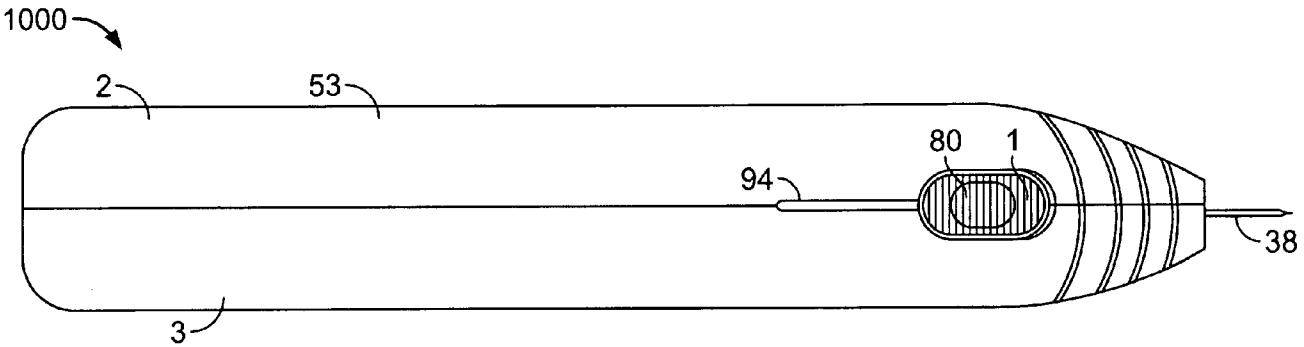
FIGS. 1 and 2 are top and side views, respectively, of a powered utility knife of the disclosure.
Figure 2:
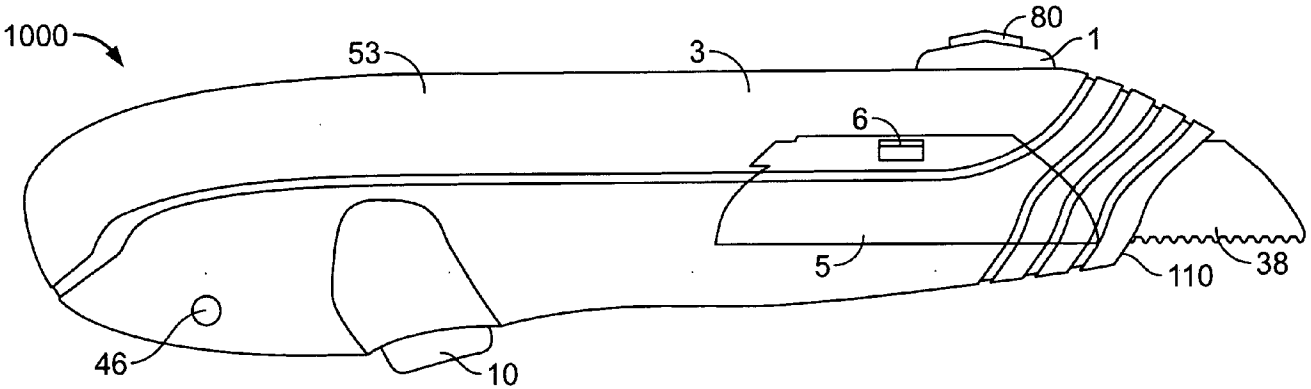

Referring to FIGS. 1 and 2, one implementation of a powered utility knife 1000 of the disclosure has an exterior configuration that includes an activator 1 for extending and locking a utility knife blade 38 for cutting in one or a number of alternative positions extending from a utility knife case or housing 53. For safety purposes, the activator 1 also retracts the blade 38 axially into the case 53, including for changing the blade. The utility knife case is ergonomically designed to provide leverage when a user applies pressure for cutting. A power switch 10 is ergonomically located for actuating the blade cutting motion, and for holding the power switch in actuating position while the user applies cutting pressure. The power switch 10 is activated only while pressure is applied by the user's finger. Once the power switch 10 is released, power to the utility knife ceases. The utility knife housing has a door 5 for ease of blade changes. In one particular implementation, described in more detail below, the utility knife is powered by batteries, which may be rechargeable and/or replaceable. In other implementations, the utility knife is powered by an external power cord and/or by a combination of battery and external power.

Trigger 80 is depressed to unlock activator 1, allowing the activator to be moved axially along the utility knife housing. When the trigger is released, the activator returns to its locking position at that location. The activator is attached to a retractable shuttle plate 19 within the utility knife housing, and travels in an activator slot 94. Forward movement of the activator (toward end 110) manually moves retractable shuttle plate 19 axially forward to extend blade 38 to a desired cutting position. When the activator 1 is moved toward a rearward position, the blade 38 is retracted. At the rearmost position of the activator, the blade is completely retracted into knife housing 53.

The utility knife housing is formed by utility knife case left portion 2 and utility knife case right portion 3, which are joined together by a case fastener, e.g. a screw (not shown). The spring-loaded door 5, e.g. for replacement of the blade, is opened by applying downward pressure upon latch release 6. Pressing and holding spring loaded power switch 10 inwardly activates power to the knife, while releasing the power switch deactivates power to the knife.

Figure 3:
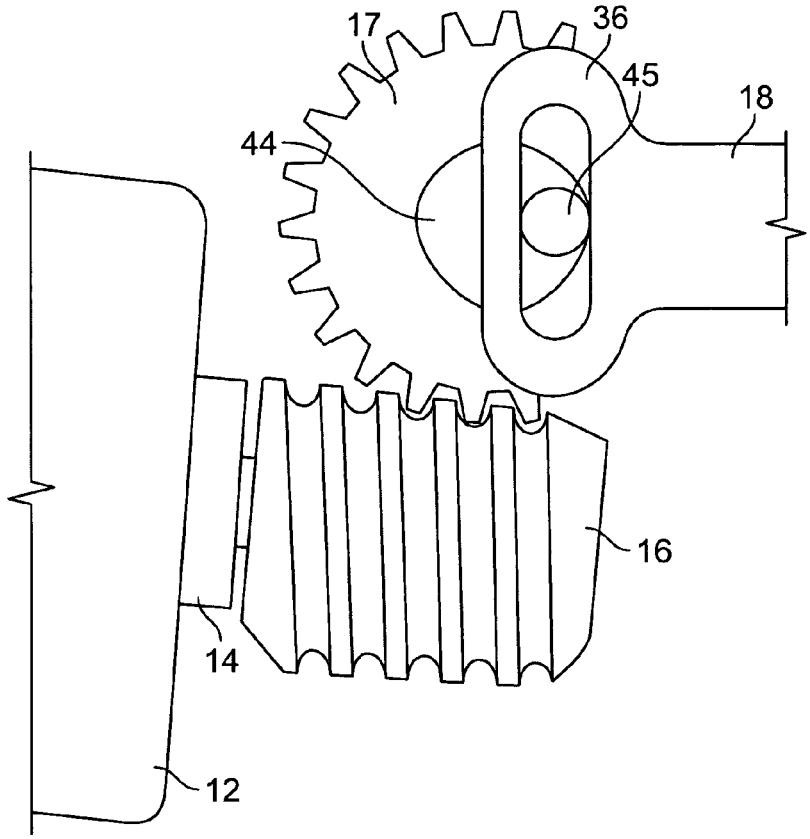
FIG. 3 is a side view of a drive worm gear and driven gear assembly for a powered utility knife of the disclosure.

Referring to FIG. 3, the utility knife has a drive system the includes a motor 12, bearing assembly 14, worm gear 16, shuttle cam 36 and cam arm 18, which permit rapid shuttling of the knife blade back and forth for power cutting.

Figure 4:
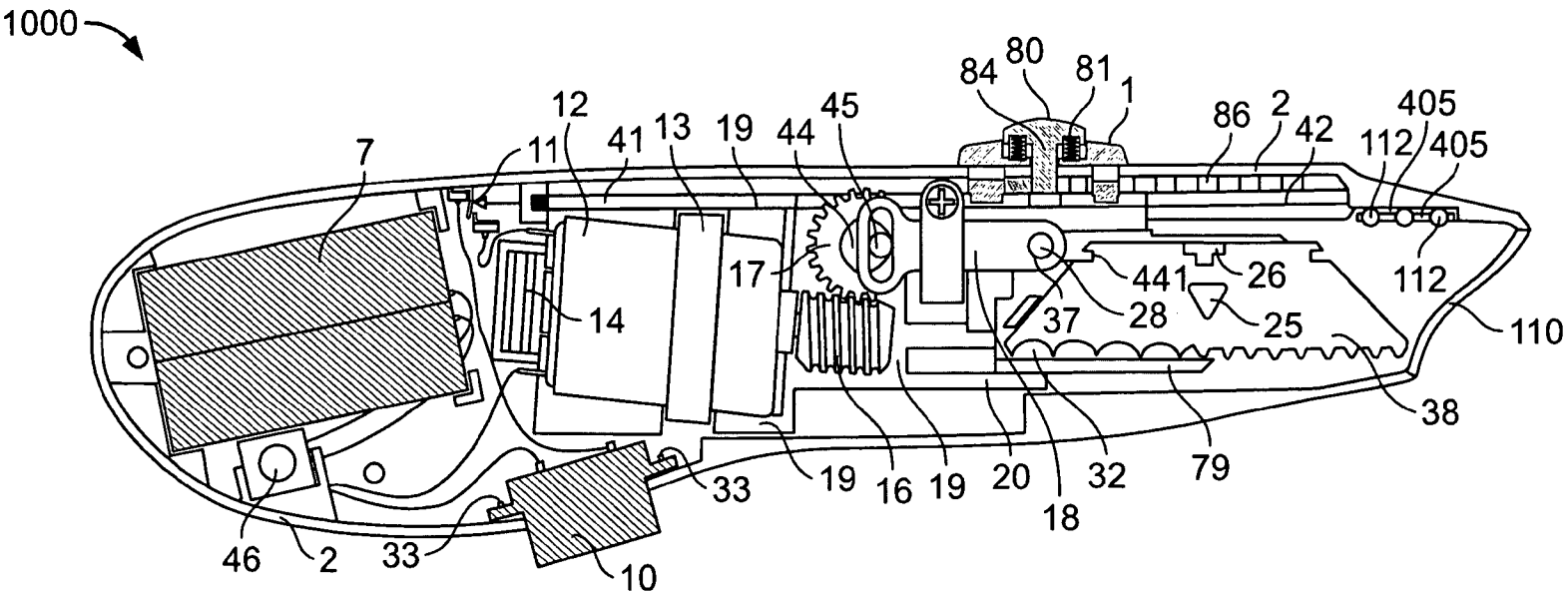
FIGS. 4 and 5 are side section views of the powered utility knife of FIG. 1, with the blade in retracted position and with the blade in extended position, respectively.

As seen in FIG. 4, when activator 1 is moved rearwardly, the blade 38 is retracted into the knife housing, and safely locked. Case left portion 2 is shown with retractable shuttle plate 19 manually retracted by activator 1 to the rear of its range of travel, retracting the blade 38 fully into the housing.

Power switch 10 is mounted to post 33. Battery 7 provides power to the drive system when activated by the user pressing and holding the spring-loaded power switch inwards. Motor 12 is mounted to retractable shuttle plate 19 by motor bracket 13. Bearing assembly 14 is a component of retractable shuttle plate 19. Cam post 28, which is attached to carrier 32 on which the blade 38 is mounted, defines a cam arm attachment hole 37.

Battery contact 8 transmits power (e.g., battery power) through wiring to switch 10, motor 12, limit switch 11 and power contacts 90 of a safety switch mounted to door 5. Limit switch 11 is a safety device that interrupts the electrical circuit when retractable shuttle plate 19 is manually retracted (as shown). Blade 38 can then be inserted or removed without actuation of power, even if power switch 10 is inadvertently pressed to "on" position. Other safety devices that may incorporated into the powered utility knife are described below.

Figure 5:
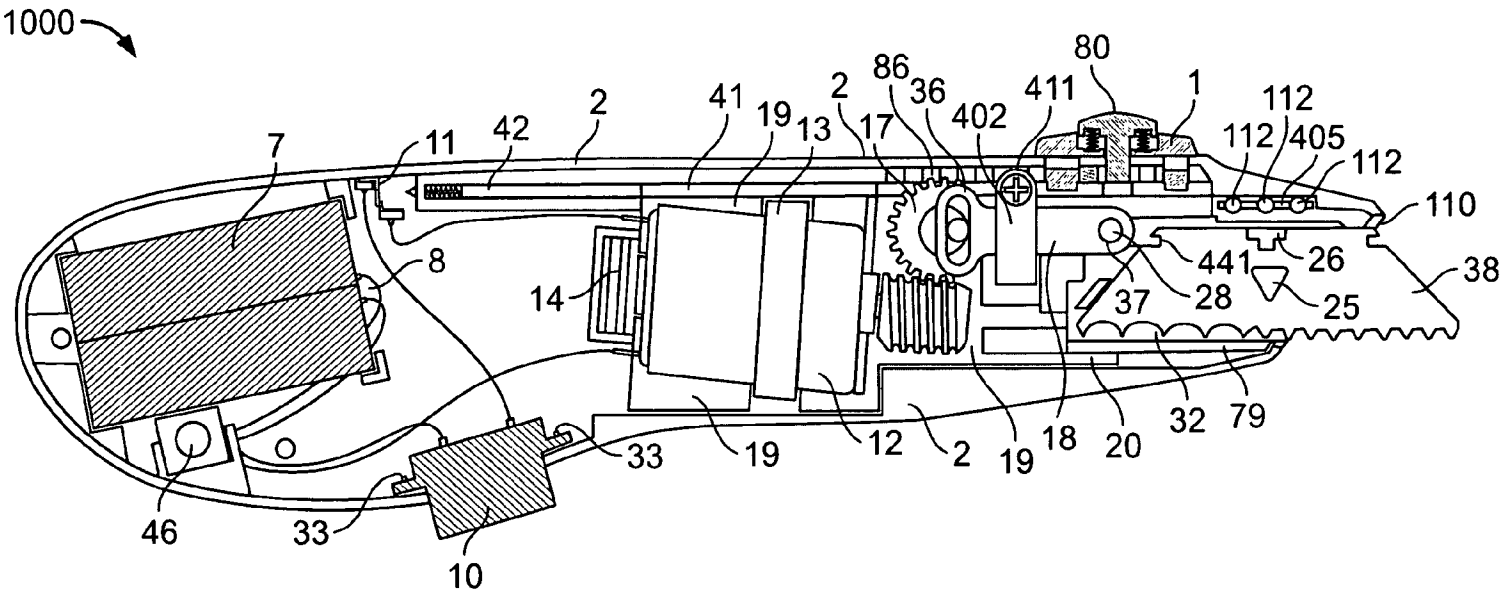

As shown on FIG. 5, when activator 1 is moved forward, the blade 38 is extended through a blade opening at the front of the knife housing 53, and then locked for cutting. Here, the retractable shuttle plate 19 is shown moved to its maximum forward position, extending blade 38 to a cutting position (different degrees of blade extension may be selected). As described above, retractable shuttle plate 19 is locked in any position to which the activator 1 is moved by release of the activator 1, which causes the spring-loaded trigger 80 to be urged upwards by trigger springs 81, automatically locking the activator against further movement. Limit switch 11 is now in open position and power is applied when the power switch 10 is pressed. Upon actuation of the power switch, cam arm 18, held in place by cam arm bracket 402 and cam arm fastener 411, moves back and forth, shuttling carrier 32 back and forth in cutting action on shuttle plate guide rails 20. A series of ball bearings 112 in ball bearing cage 405 allow the carrier 32 to operate efficiently with minimal friction when articulating back and forth in the power cutting mode, even while considerable force is being applied to the utility knife during the cutting process with blade 38. Force applied to case left 2 and case right 3 is transmitted directly to shuttle plate shoulders 41 of retractable shuttle plate 19. Simultaneously, blade 38, extended in the cutting position, pushes carrier 32 upwards so that ball bearings 112 in ball bearing cage 405 above carrier 32, now in contact with the underside of retractable shuttle plate 19 and the underside of case left 2 and case right 3, permit the carrier 32 to easily move back and forth in the power cutting mode.

The motor 12, powered by battery 7, drives the drive worm gear 16, which in turn drives driven gear 17. Cam arm 18 is attached to driven gear 17 by engagement upon mounting pin 45 of cam drive post 44 and attached to retractable shuttle plate 19 engagement of cam arm attachment hole 37 upon cam arm post 28. Rotation of the driven gear moves the cam arm back and forth, which in turn move blade carrier 32 back and forth in cutting motion. In one implementation, battery 7 is recharged through battery recharging port 46.

Figure 6:
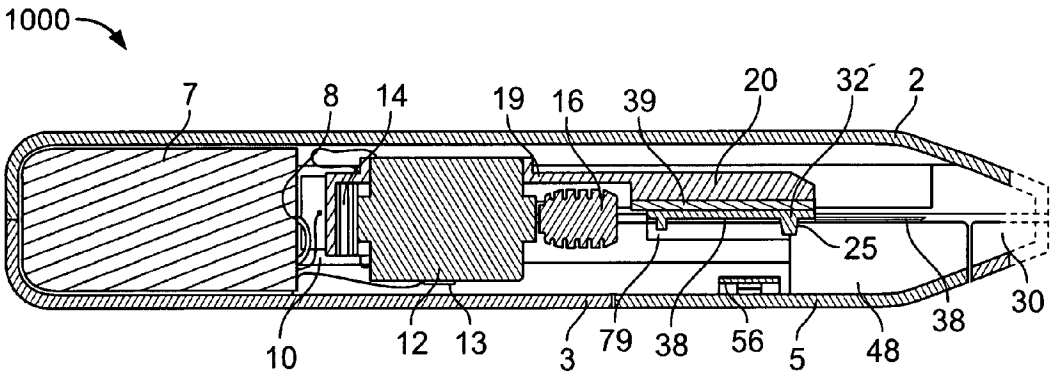
FIGS. 6 and 7 are top section views of the powered utility knife of FIG. 1, with the blade in retracted position, as in FIG. 4, and with the blade in extended position, as in FIG. 5, respectively.

Referring to FIG. 6, retractable shuttle plate 19 is manually moved to its rearmost position by means of activator 1, retracting the blade 38 completely within knife housing 53. Lower blade support 48 on door 5 and lower blade support 30 on knife case right portion 3 together hold blade 38 securely to carrier 32 during all phases of carrier 32 travel.

Figure 7:
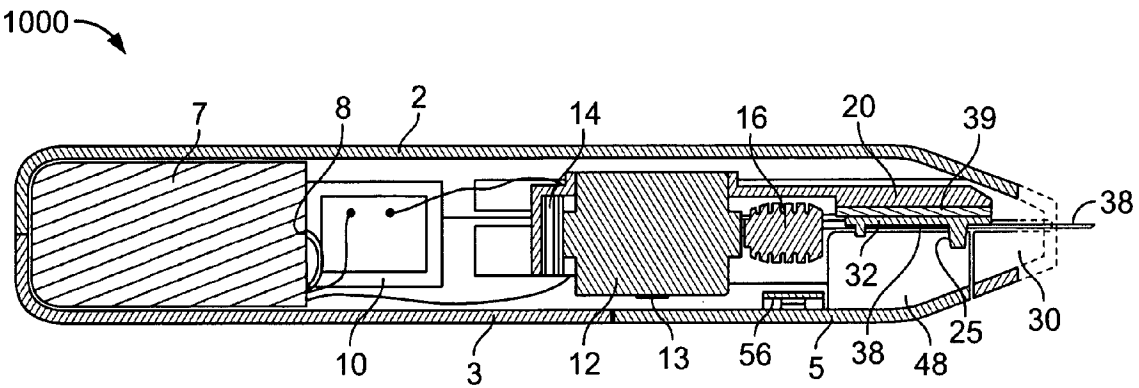

In FIG. 7, retractable shuttle plate 19 is manually moved forward by means of activator 1 to extend the blade 38 to its cutting positions. Lower blade support 30 and door-mounted lower blade support 48 securely hold blade 38 against carrier 32.

Figure 8:
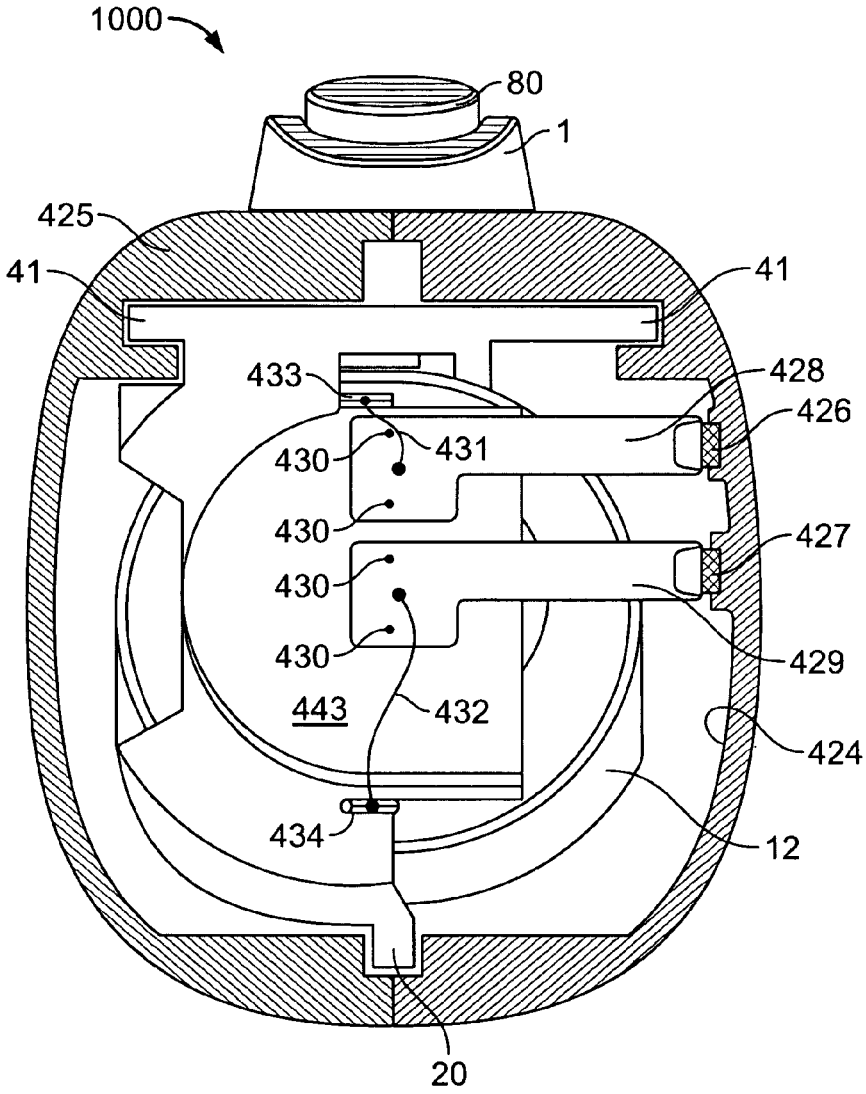
FIGS. 8 and 9 are end section and side section view, respectively, of another implementation of a powered utility knife of the disclosure, with sliding electrical connection between contacts mounted to the shuttle plate and to the utility knife housing.
Figure 9:
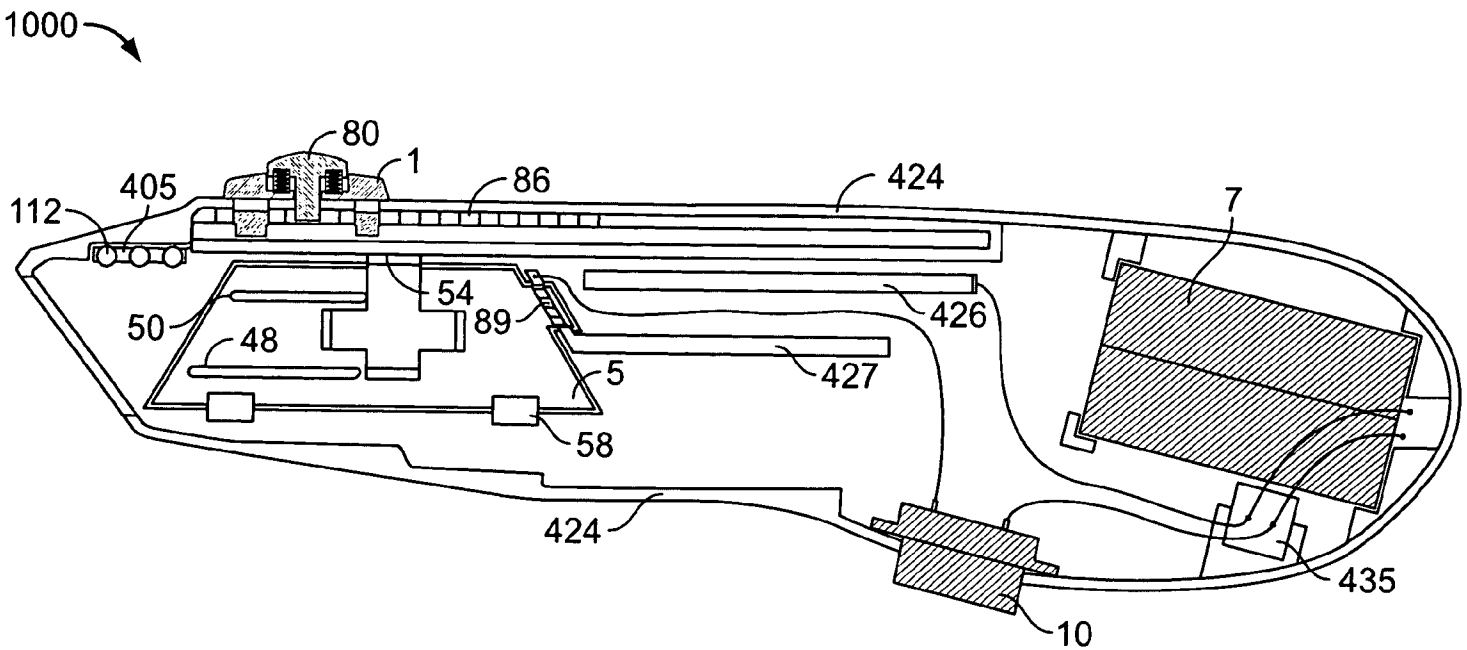

In one implementation of the powered utility knife 1001 of the disclosure, sliding electrical contacts are provided for the shuttle plate, to eliminate folding and unfolding of electrical wires as the shuttle plate and motor move back and forth as the utility knife blade is extended and retracted. Referring to FIGS. 8 and 9, fixed electrical contact strips 426 and 427 are mounted to the inside wall 424 of the utility knife housing 425. Upper and lower sliding electrical contacts 428 and 429 are mounted to the rear bearing assembly housing 443 by sliding electrical contact fasteners 430. Upper motor contact wire 431 completes the electrical circuit between upper sliding electrical contact 428 and upper motor electrical contact 433. Lower motor contact wire 432 completes the electrical circuit between lower sliding electrical contact 429 and lower motor electrical contact 434. When the utility knife blade is extended or retracted, retractable shuttle plate shoulders 41 ride in shuttle plate channels 42, moving motor 12 forward and rearward, and moving upper and lower sliding electrical contacts 428 and 429 along fixed electrical contact strips 426 and 427, which are, in turn, connected to battery 7 (power source). Upper fixed electrical contact strip 426 is electrically connected to battery charging module 435, which connects to battery 7 and power switch 10. Lower fixed electrical contact strip 427 is connected through door 5 power breaker 89 to wiring leading to battery charging module 435 and battery 7.

Figure 10:
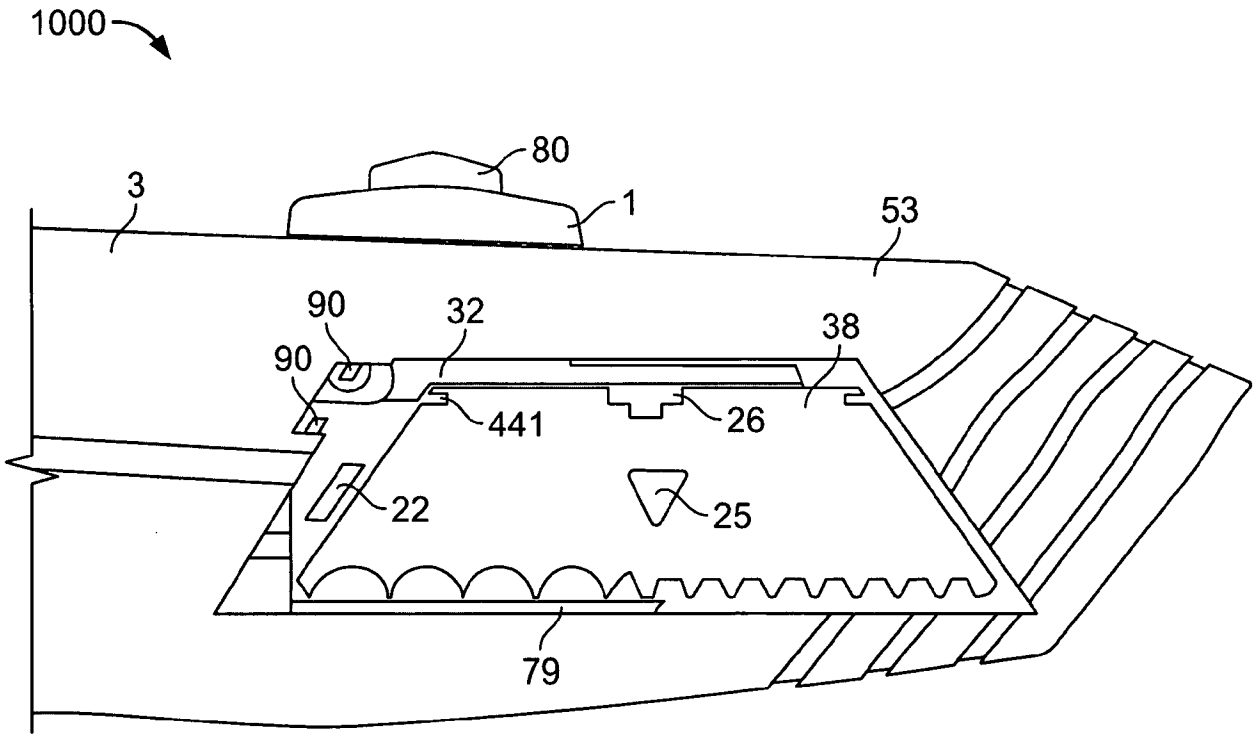
FIG. 10 is a partial side view of a powered utility knife of FIG. 1, with the utility knife door removed and the utility knife blade fully positioned in the door aperture for removal.

Referring next to FIG. 10, the activator 1 is moved to rearward along the exterior of the case 53. With the retractable shuttle plate 19 manually moved to its rearmost position, blade 38 is positioned fully within the aperture of door 5 and exposed for removal. The door 5 is shown removed for access to the blade 38. The aperture of door 5 is wide enough to accommodate the range of positions over which the shuttle mechanism may have stopped the carrier 32 and blade 38 in its powered cutting motion when shuttle plate 19 is fully retracted. Thus, the entire blade 38 is accessible for removal and/or insertion.

As a safety feature, when the door 5 is opened power contacts 90 are removed from contact with door-mounted power breaker 89, interrupting the electrical circuit. A user changing the blade is thus protected from having the power started, e.g. should he or she inadvertently press power switch 10, since while the door 5 is open for changing blade 38, interruption in the electrical circuit restricts the motor 12 from actuation to move the carrier 32 with the blade 38.

As an additional safety precaution, when the retractable shuttle plate 19 carrying motor 12 is retracted to bring the blade into line with door 5 for blade changing, lower sliding electrical contact 429 runs beyond the end of the relatively shorter lower fixed electrical contact strip 427, thereby interrupting the electrical connection as the blade is position placed inline with door 5.

A further safety precaution is provided by contact of retractable shuttle plate 19, when fully retracted, with limit switch 11 to interrupt the circuit, as described below in more detail with reference to FIGS. 18 and 19.

Figure 11:
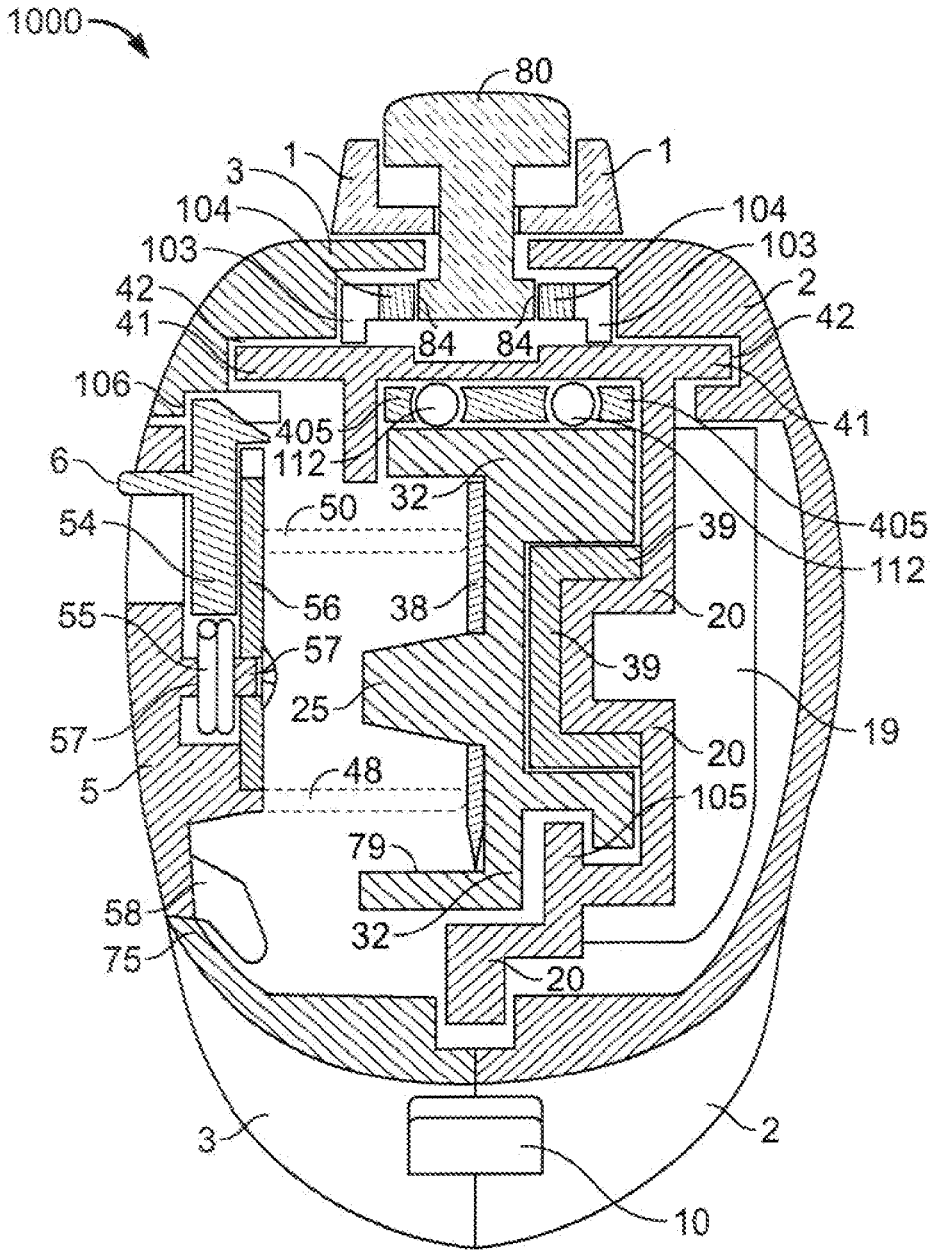
FIG. 11 is an end section view of a powered utility knife of the disclosure with a retractable shuttle plate.

Referring to FIG. 11, the retractable shuttle plate 19 moves back and forth in channel 42. Articulating carrier 32 rides on guide rails 20 and 39 when power shuttling back and forth in cutting motion. The activator 1 is shown in a locked position with trigger 80 in an "up" position, placing trigger lock 84 between locking arms 104. This restricts dislodgement of locking shoulders 103 from locking pocket 86. Door upper blade support 50 and door lower blade support 48 hold blade 38 securely against carrier 32. Shuttle plate shoulder 41 rides within shuttle plate support channel 42 when manually moving the retractable shuttle plate 19 forward and rearward. Retractable shuttle plate 19 defines shuttle plate guide rails 20, 39 that extend forward of the body of the main shuttle plate 19 to supporting carrier 32 in a fashion that allows carrier 32 to ride securely back and forth within carrier rails 105. Plastic guide rails 20, 39 serve as the primary movement contact surfaces and reduce friction, allowing power shuttling of carrier 32 to slide easily back and forth. Loading and/or removing blade 38 from the utility knife is achieved efficiently by use of a blade tray 79 and blade loading assist 25. Door hinge prong 58 is positioned on and behind prong engager 75 when door 5 is attached to knife case right portion 3. Door latch 54 secures the door closed by latch spring 55 forcing door latch 54 up behind latch lock 106.

Figure 12:
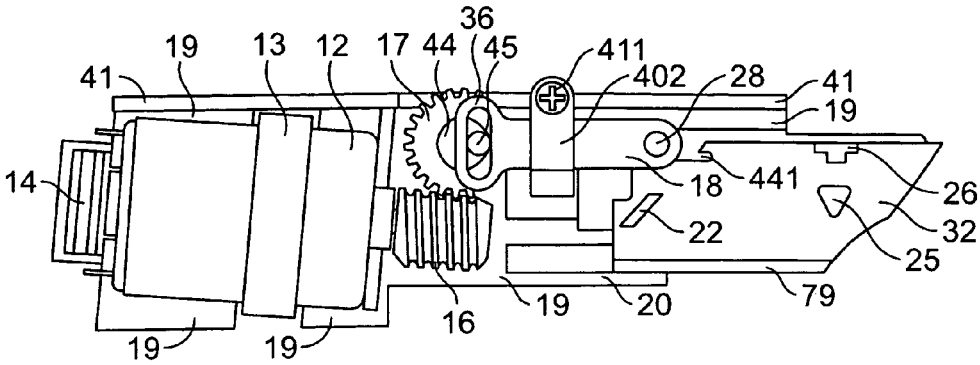
FIGS. 12 and 13 are partial side section views of a powered utility knife with the utility knife blade carrier moved to its maximum forward shuttle stroke position, and with the utility knife blade carrier moved to its rearward shuttle stroke position, respectively.

In FIG. 12, the power assembly has the cam arm 18 in its extended position, moving carrier 32 to its maximum forward shuttle stroke position of its back and forth powered cutting movement. The power feature moves the carrier 32 back and forth along shuttle plate guide rails 20 of shuttle plate 19.

Figure 13:
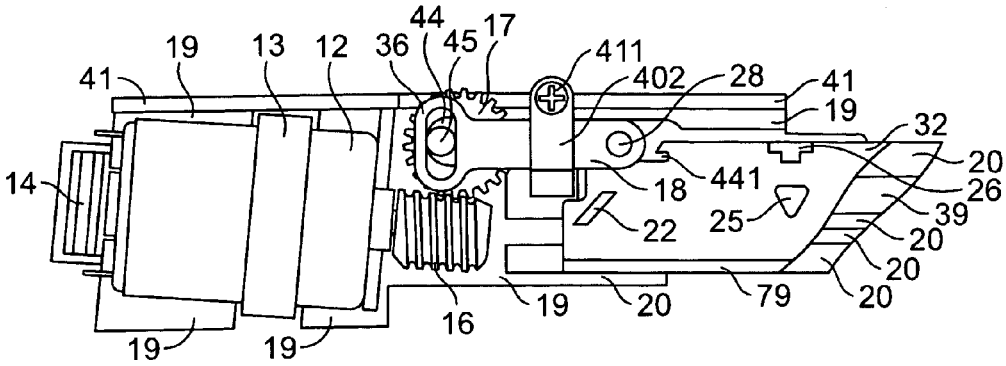

In FIG. 13, the power assembly has the cam arm 18 in its retracted stroke position, moving carrier 32 to its rearward powered shuttle stroke position of its back and forth powered cutting movement.

Figure 14:
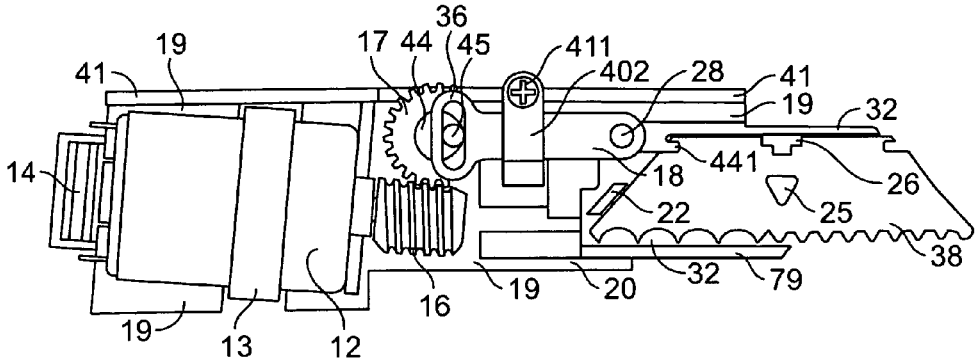
FIG. 14 is a partial side section view of the powered utility knife of FIGS. 12 and 13 with a utility knife blade mounted to the utility knife blade carrier.

Referring to FIG. 14, the power assembly of FIGS. 12 and 13 is shown with blade 38 attached to carrier 32. The carrier 32 defines an upper side engager 441 and a middle blade pusher 22, which engage rear surface of the blade 38 when pushing the blade 38 in its forward cutting direction. Upper blade engager 26 and blade loading assist 25 extend through apertures in a center region of the blade 38 and push blade 38 in both forward and rearward cutting directions. Blade tray 79 assists in positioning of the blade 38 when loading blade 38 onto the carrier 32.

Figure 15:
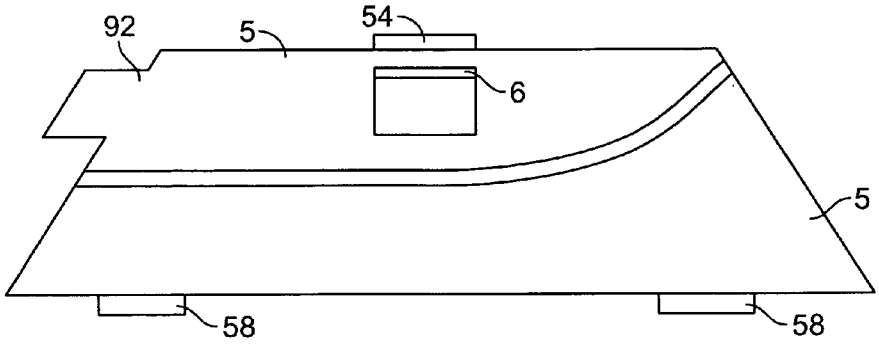
FIGS. 15 and 16 are exterior face plan and interior face plan views, respectively, of a powered utility knife door of the disclosure.

As shown in FIG. 15, door 5 has door release 6 in a locked position. Pushing spring-loaded release 6 downward unlocks door 5. Door hinge prongs 58 attach a lower portion of door 5 to prong engager 75 on knife case right portion 3 and pivot the door 5 upwards to close, engaging door latch 54 to latch lock 106 to lock the door 5 in place.

Figure 16:
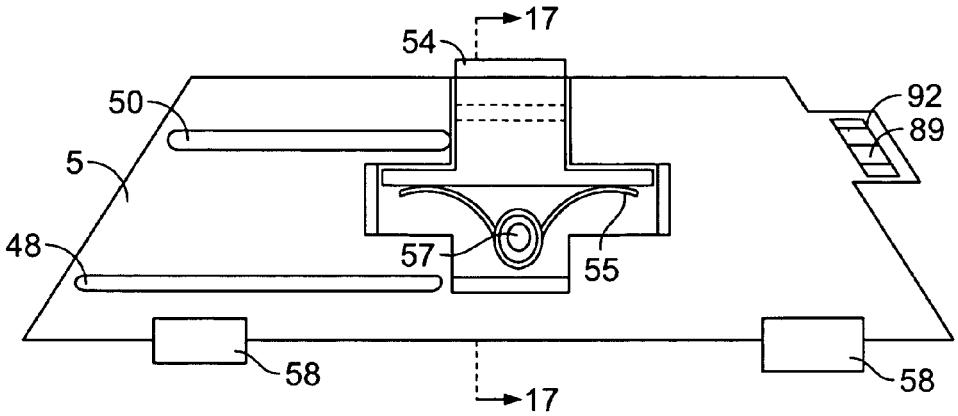

As shown in FIG. 16, the door latch 54 has a latch spring 55 urging the door latch 54 upwards. The latch spring is mounted to spring post 57. Door upper blade support 50 and door lower blade support 48 hold blade 38 securely against the carrier 32. Power breaker 89 is attached to door extension 92 and completes the electrical circuit when engaged between contacts 90 of the safety switch assembly.

Figure 17:
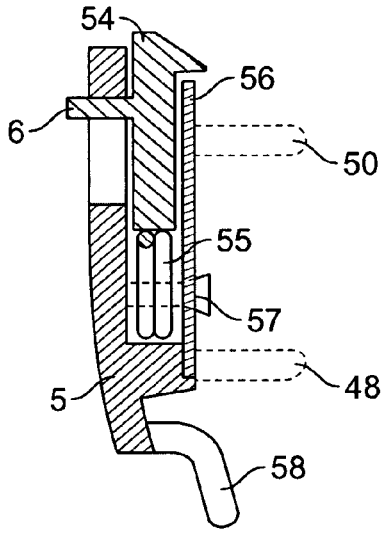
FIG. 17 is an end section view of the powered utility knife door, taken at the line 17—17 of FIG. 16.

Referring next to FIG. 17, the details of door latch 54, latch release 6, latch spring 55, spring post 57, door upper blade support 50, door lower support 48, latch retaining plate 56, which holds latch assembly in place, and door hinge 58 are more fully illustrated.

Power to the utility knife is always off unless and until the user presses and holds the power switch 10. However, as a safety precaution, to minimize or eliminate any possibility that the power may be actuated inadvertently, such as during blade changing, additional safety features are provided.

Figure 18:
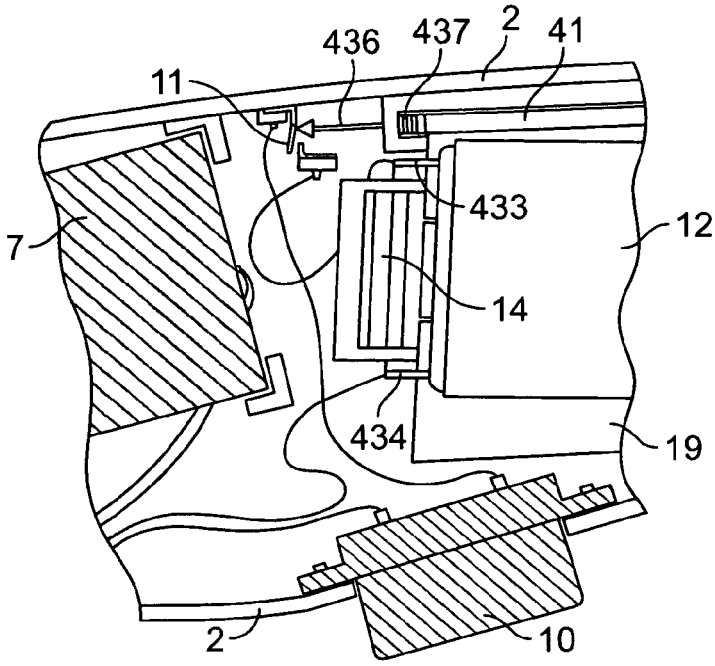
FIGS. 18 and 19 are fragmentary side section views of a powered utility knife of the disclosure, with a first safety limit switch open, to interrupt power, due to retraction of the shuttle plate, and with the first safety limit switch closed, to permit flow of power, due to extension of the shuttle plate, respectively.
Figure 19:
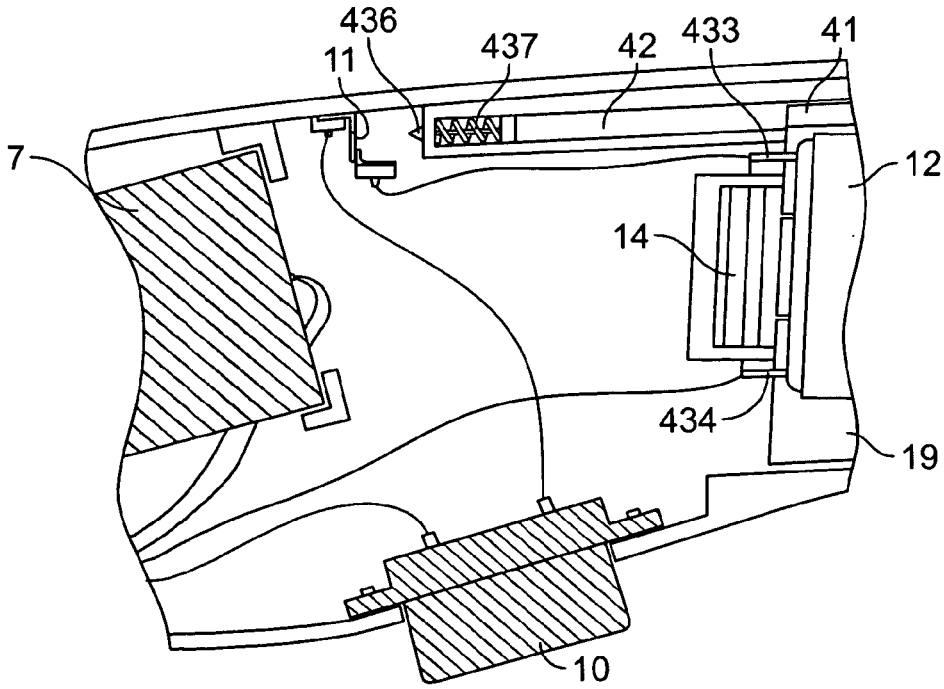

Referring to FIGS. 18 and 19, a first safety limit switch 11 interrupts the electrical circuit when the retractable shuttle plate 19 is manually retracted into the utility knife housing by movement of the activator 1. In FIG. 18, activator 1 has moved retractable shuttle plate 19 to the rear, retracting the blade inside the utility knife housing, where the shuttle plate shoulder compresses plunger return spring 437 and pushes limit switch plunger 436 into engagement with limit switch 11, to open limit switch 11, thereby interrupting all electrical connections, including any electrical connection to power switch 10. This restricts actuation of the knife blade, should the user inadvertently hit the power switch 10 while blade is being changed.

Referring next to FIG. 19, when the activator 1 has moved shuttle plate 19 forward to the extend blade from the utility knife housing, the plunger return spring is extended, pulling the limit switch plunger forward and allowing limit switch 11 to close, completing the circuit for connection of all electrical power.

Figure 20:
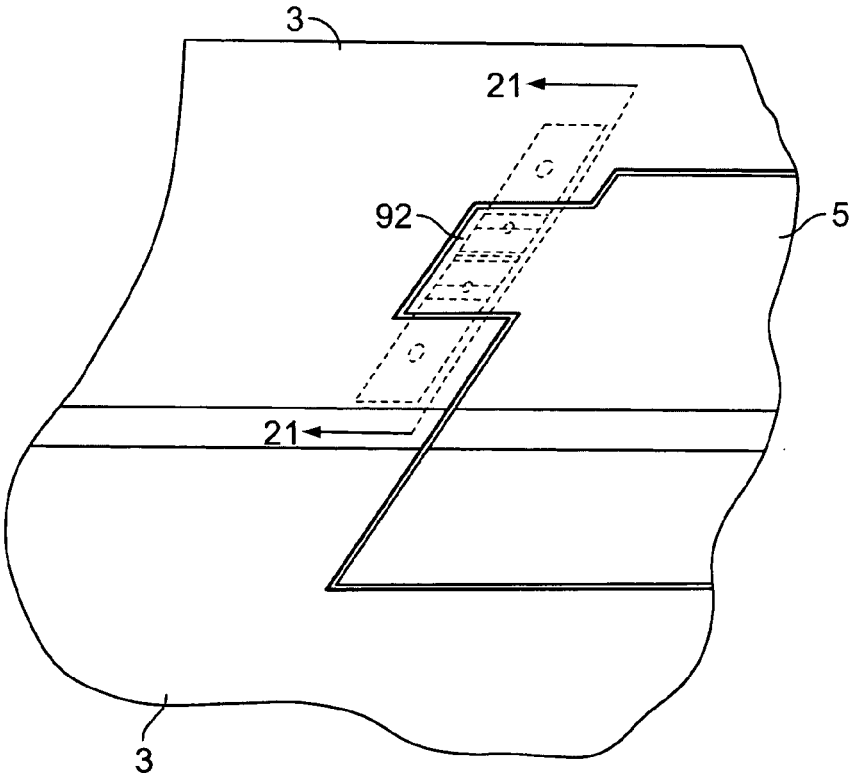
FIG. 20 is a partial side view of the powered utility knife of FIG. 2, showing a segment of the utility knife door.
Figure 21:
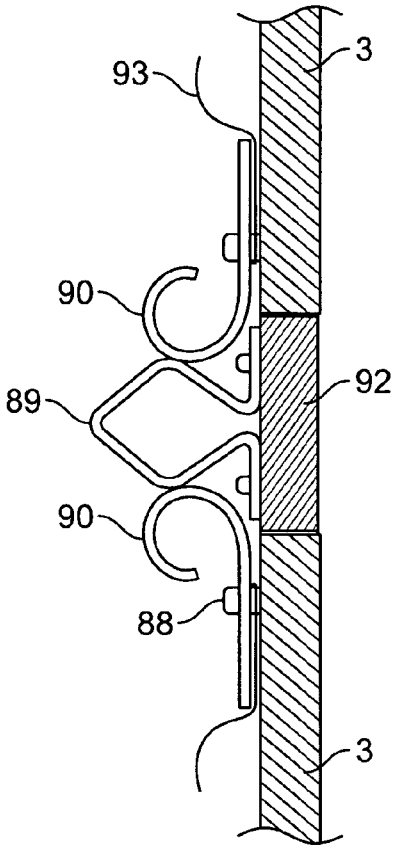
FIGS. 21 and 22 are end section views, both taken at the line A—A of FIG. 20, with the utility knife door in closed position, and with the utility knife door in open position, respectively.
Figure 22:
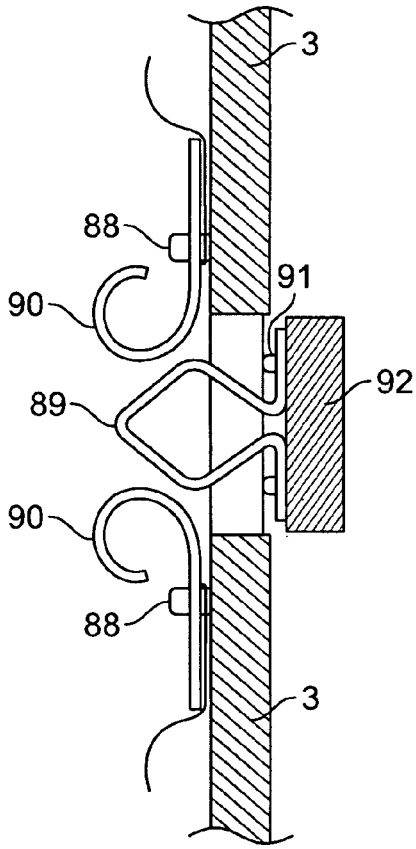

Referring next to FIGS. 20 to 22, a second safety limit switch interrupts the electrical circuit when the utility knife door 5 (FIG. 2) is open, removing power breaker 89 from electrical contact with power contact 90. FIG. 20 shows a fragmentary cross-section of utility knife case right portion 3 of the utility knife shown in FIG. 2 with a utility knife door 5 having a door extension 92. In FIG. 21, the utility knife door 5 is closed, and power breaker 89, mounted on door extension 92, completes the electrical circuit between power contacts 90, which are fastened to case right portion 3 of the utility knife housing by contact posts 88. Power wires 93 are attached to contact posts 88 to bring power from battery 7 to power contacts 90. In FIG. 22, the utility knife door is open, and power breaker 89 at the inside of utility knife case right portion 3 of the utility knife housing is pulled away from power contacts 90, interrupting the electrical circuit. The power breaker 89 is mounted to door extension 92 by breaker posts 91.

Figure 23:
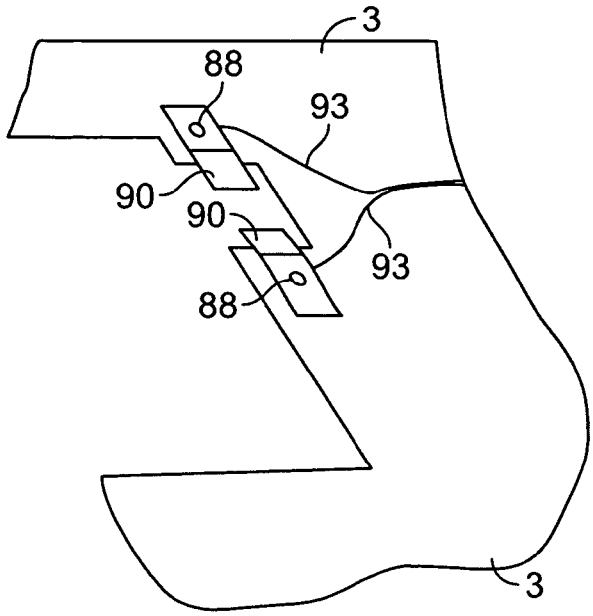
FIGS. 23 and 24 are partial side views of an interior wall of the powered utility knife of FIG. 2 showing a segment of the utility knife door aperture, with the door removed, and with the door in place, respectively.
Figure 24:
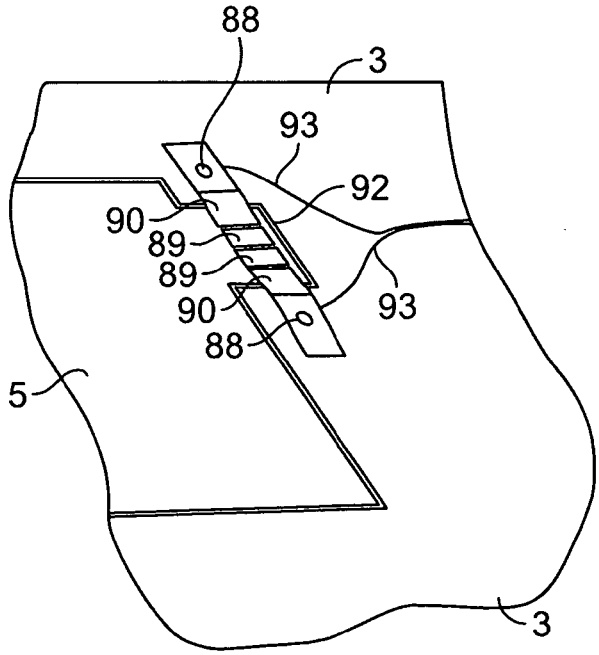

We refer next to FIGS. 23 and 24, in which a fragmentary section of the inner surface of utility knife case right portion 3 of the utility knife housing, including a portion of the utility knife door aperture, is shown. In FIG. 23, the utility knife door is removed, illustrating power contacts 90 attached by contact posts 88. Power wires 93, also attached to contact posts 88, provide electrical power to power contacts 90. While the door 5 is removed, as shown, the electrical circuit is interrupted. In FIG. 24, the utility knife door 5 is replaced, with power breaker 89, attached to door extension 92, completing an electrical circuit between power contacts 90.

As shown in FIGS. 25 to 31, the activator 1 has an automatic locking function. Activator 1 is attached to retractable shuttle plate 19 to move the shuttle plate 19, with the carrier 32 and blade 38, forward so that the blade 38 extends to optional cutting positions outside the knife housing 53. When the activator 1 is moved is rearwards, it retracts the blade 38 completely inside the knife housing 53. When the user's finger is applied to the activator 1 to move it forward or backwards, a trigger 80 on top of the activator 1 is pressed downward, unlocking the activator 1 so it is free to move. Once the blade 38 is moved to its desired position, the activator 1 automatically locks in that position when the user releases the activator 1 and trigger 80.

Figure 25:
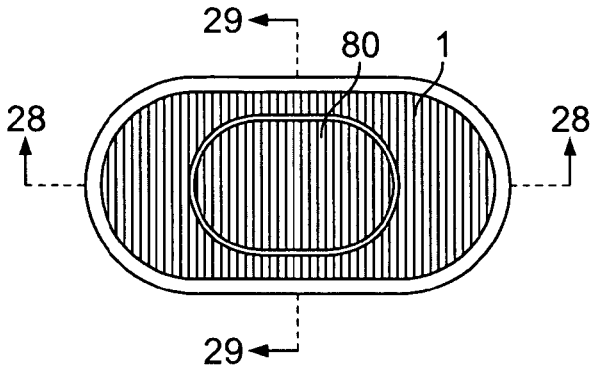
FIGS. 25, 26 and 27 are top plan, side and end views, respectively, of an activator for a powered utility knife of the disclosure.
Figure 26:
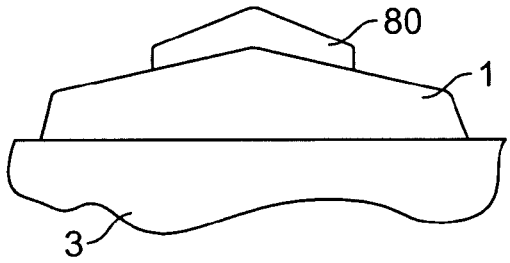
Figure 27:
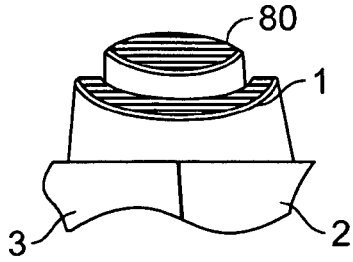

FIGS. 25, 26 and 27 show a top view, side view and end view, respectively, of the activators and the trigger 80.

Figure 28:
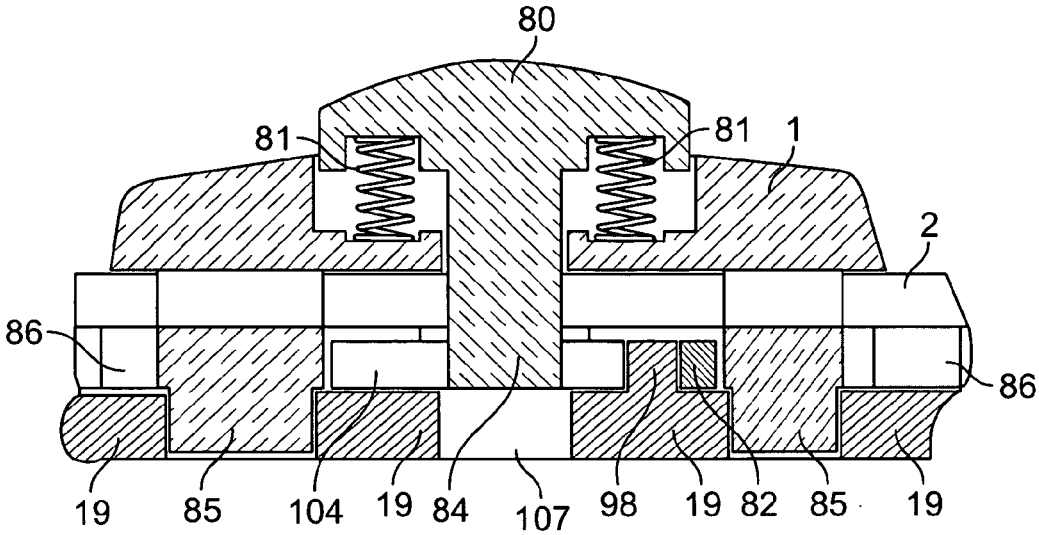
FIGS. 28 and 30 are side section views, taken at the line J—J of FIG. 25, of an activator for a powered utility knife of the disclosure, shown in locked mode and shown in unlocked mode, respectively.
Figure 29:
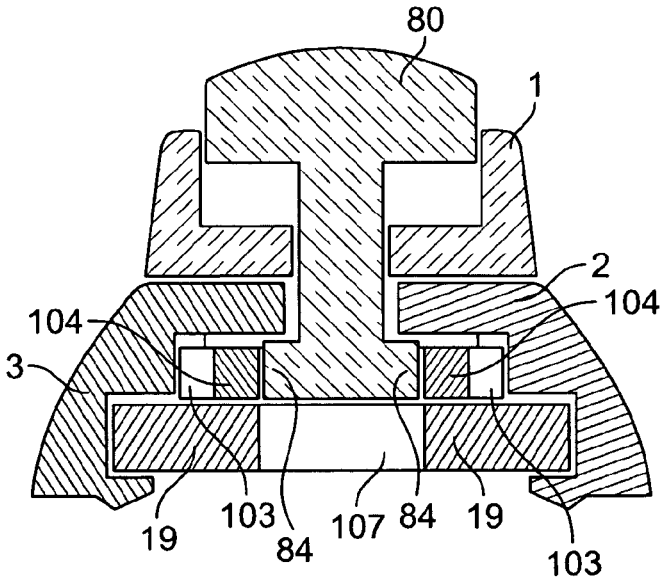
FIGS. 29 and 31 are end section views, taken at the line K—K of FIG. 25, of an activator for a powered utility knife of the disclosure, shown in locked mode, as in FIG. 28, and shown in unlocked mode, as in FIG. 30, respectively.

FIGS. 28 and 29 show cross-sections of side and end views, respectively, of the activator assembly in locked mode. Activator 1 includes trigger 80 biased upwards by trigger springs 81 into the locked position. Trigger lock 84 is positioned between locking arms 104 of locking spring 82, restricting any movement inward, thereby freezing locking shoulders 103 in locking pockets 86. This restricts activator 1 and retractable shuttle plate 19 from being moved forward or backwards. Activator 1 is anchored by activator anchor points 85 in retractable shuttle plate 19 and held into position by case left portion 2 and case right portion 3 of the utility knife housing.

Figure 30:
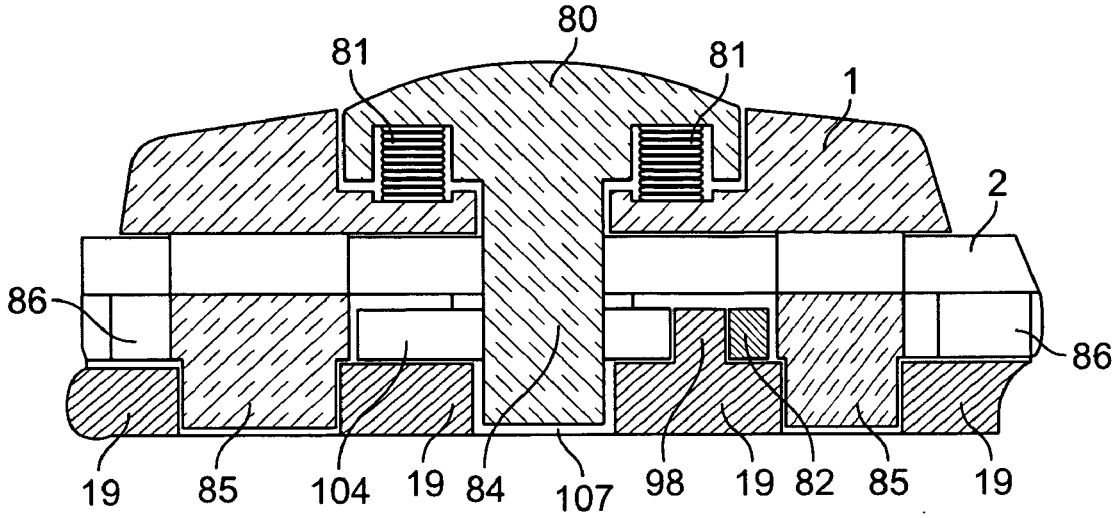
Figure 31:
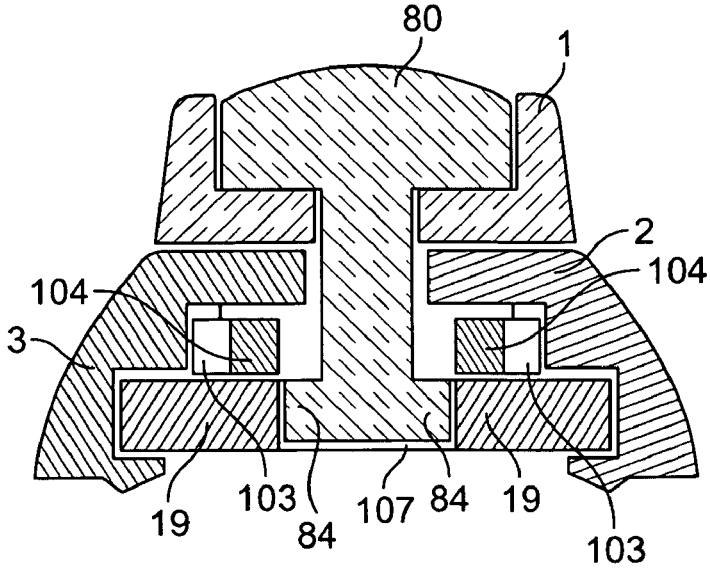

FIGS. 30 and 31 show cross-section side and end views, respectively, of the activator assembly in unlocked mode. Activator 1 includes trigger 80 pressed downward to unlock locking arms 104 by compressing trigger springs 81. Moving trigger lock 84 from between locking arms 104, into region 107, allows the pliable locking arms 104 to bend inward as locking spring 82 is pushed by activator 1 as it is adjusted backwards or forwards.

Figure 32:
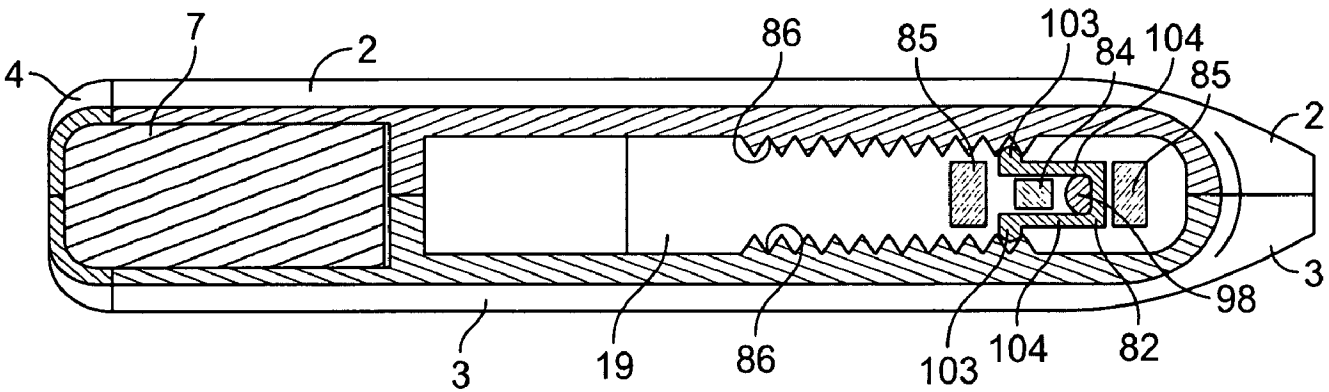
FIG. 32 is a top section view of the activator for a powered utility knife of the disclosure.

As shown in FIGS. 29 and 32, the pliable locking arms 104 are restrained from bending towards one another by trigger lock 84, thereby engaging the locking shoulders 103 in locking pockets 86. Locking spring 82 is attached to the activator 1 by retractable shuttle plate post 98, activator anchor point 85, case right portion 3 and case left portion 2. When locking spring 82 is locked into locking pockets 86, the retractable shuttle plate 19, carrier 32 and blade 38 are all locked in place. There are a number of locking pockets 86 defined by the knife case right portion 3 and knife case left portion 2 into and out of which the locking shoulders 103 articulate as they pass. Once the blade 38 is moved to its desired position, activator 1 is released, allowing trigger 80 to be urged upwards by trigger springs 80, raising trigger lock 84 to a position between locking arms 104 of locking spring 82. This restricts locking shoulders 103 from moving out of the locking pockets 86 of that location.

As shown in FIG. 32, the activator 1 is now locked in place. Locking shoulders 103 are engaged in locking pockets 86. The ends of the pliable locking arms 104 are restrained from bending towards one another by trigger lock 84, thereby locking shoulders 103 in locking pockets 86. When locking spring 82 is locked into locking pockets 86, retractable shuttle plate 19, carrier 32 and blade 38 are all locked in place.

Figure 33:
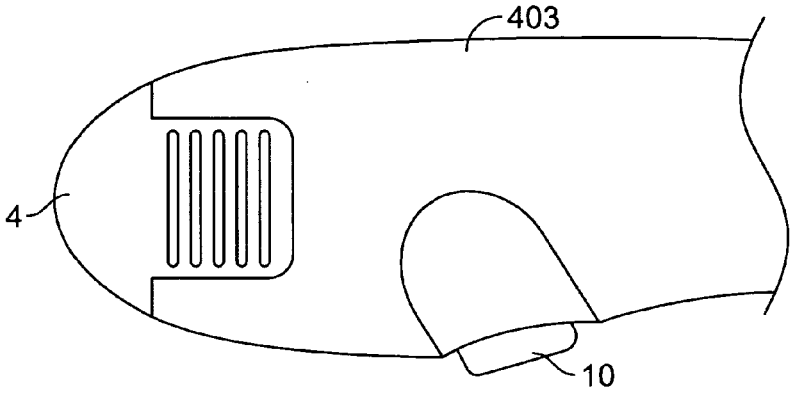
FIGS. 33 and 34 are side views of the rear end portion of a powered utility knife of the disclosure, showing a removable battery cartridge engaged with the housing, and showing the battery cartridge disengaged from the housing, respectively.
Figure 34:
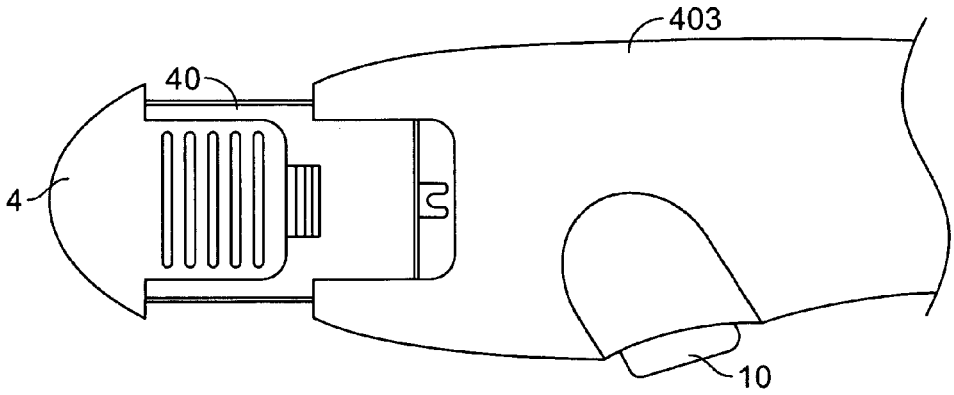

Referring now to FIGS. 33 and 34, in one particular implementation, the utility knife is powered by batteries, which can be rechargeable and/or replaceable. In this implementation, a battery cartridge 40 is engaged with the utility knife housing 403 by battery cover 4 (FIG. 33). The battery cartridge 40 is removed by gripping the battery cover 4 and pulling it axially rearward to disengage the battery cover from the utility knife housing.

Referring to FIGS. 35–39, a number of particular style blades are provided, including for use with the power utility knife of the disclosure. The blades have particular cutting features suited for different cutting applications.

Figure 35:
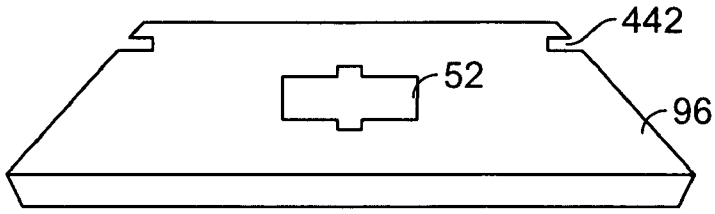
FIGS. 35 to 40 are side plan views of various implementations of utility knife blade configurations for use in powered utility knives of the disclosure.

In FIG. 35, blade 96 defines a sharp cutting edge along its bottom and curved or angled ends. To assist in keeping the blades 96 firmly attached to carrier 32 during its rapid powered shuttling back and forth, each blade 96 defines a loading assist opening 52 that receives blade support 64, and notch 442 that receives side engager 441.

Figure 36:
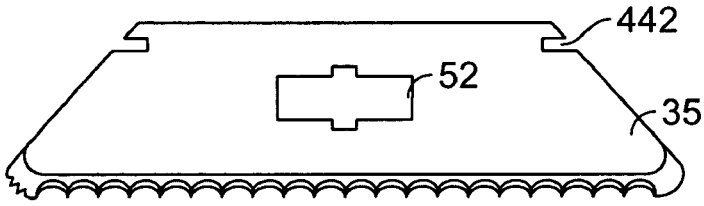

In FIG. 36, blade 35 defines a sharp serrated detail along bottom edge. To assist in keeping blades 35 firmly attached to carrier 63 during its rapid powered shuttling back and forth, each blade 35 defines a loading assist opening 52 that receives blade support 64, and notch 442 that receives side engager 441.

Figure 37:
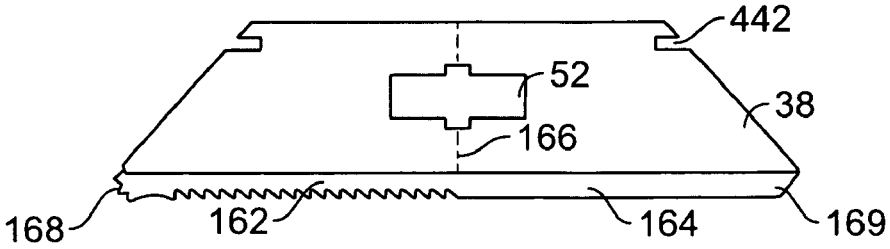

In FIG. 37, alternate blade 38 defines a bottom edge with two different details on each side of centerline 166, i.e. angled saw teeth 162 and straight Sharpe edge 164 with beveled end 168 with saw teeth on the bevel and a sharp angled end 169. To assist in keeping the saw teeth blades 38 firmly attached to carrier 63 during its rapid powered shuttling back and forth, each blade 38 defines a notch loading assist opening 52 that receives blade support 64, and notch 442 that receives side engager 441.

Figure 38:
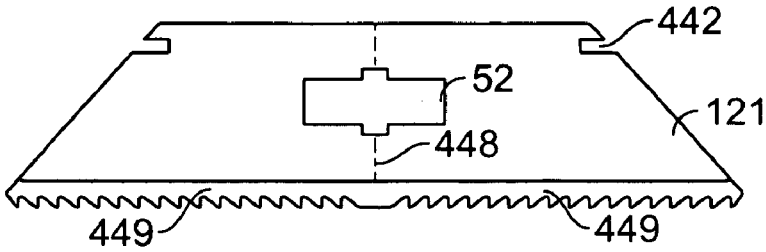

In FIG. 38, another alternative blade 121 has sharp teeth 449 along the bottom edge. The tooth design of the teeth 449 is configured in such a manner that the aggressive cutting edge of each tooth is always facing inward during its articulating cutting stroke. This is achieved by having a mirror image of the tooth profiled on each side of a centerline 448 of the blade. When the blade 121 is rotated to utilize the unused half of the blade 121, the aggressive cutting edge of the teeth 449 are again facing inward during the cutting stroke. To assist in keeping the blades 121 firmly attached to carrier 63 during its rapid powered shuttling back and forth, each blade 121 defines a loading assist opening 52 that receives blade support 64, and notch 442 that receives side engager 441.

Figure 39:
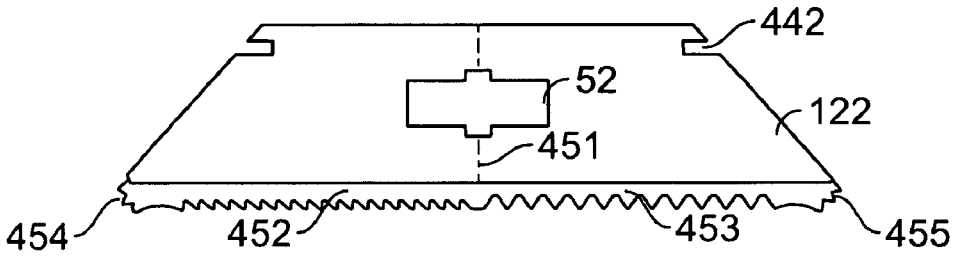

In FIG. 39, another alternative blade 122 defines a cutting edge with two different details on each side of centerline 451 angled saw teeth 452 and coarse teeth 453 with angled ends 454 and 455 containing saw teeth. To assist in keeping the blade 122 firmly attached to carrier 63 during its rapid power shuttling back and forth, each blade defines a loading assist opening 52 that receives blade support 64, and notch 442 that receives side engager 441.

Figure 40:
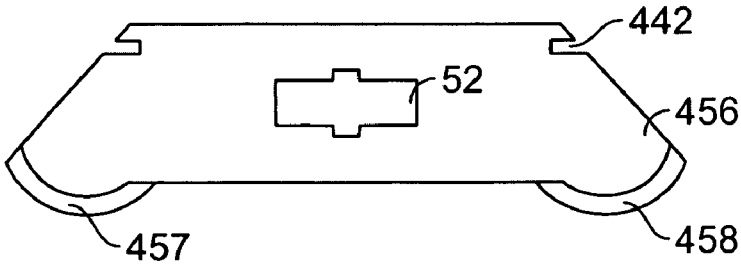

In FIG. 40, another alternative blade 456 defines a semicircular cutting edge 457, 458 at each end of the blade. To assist in keeping the blade 456 firmly attached to carrier 63 during its rapid power shuttling back and forth, each blade 456 defines a loading assist opening 52 that receives blade support 64, and notch 442 that receives side engager 441.

Figure 41:
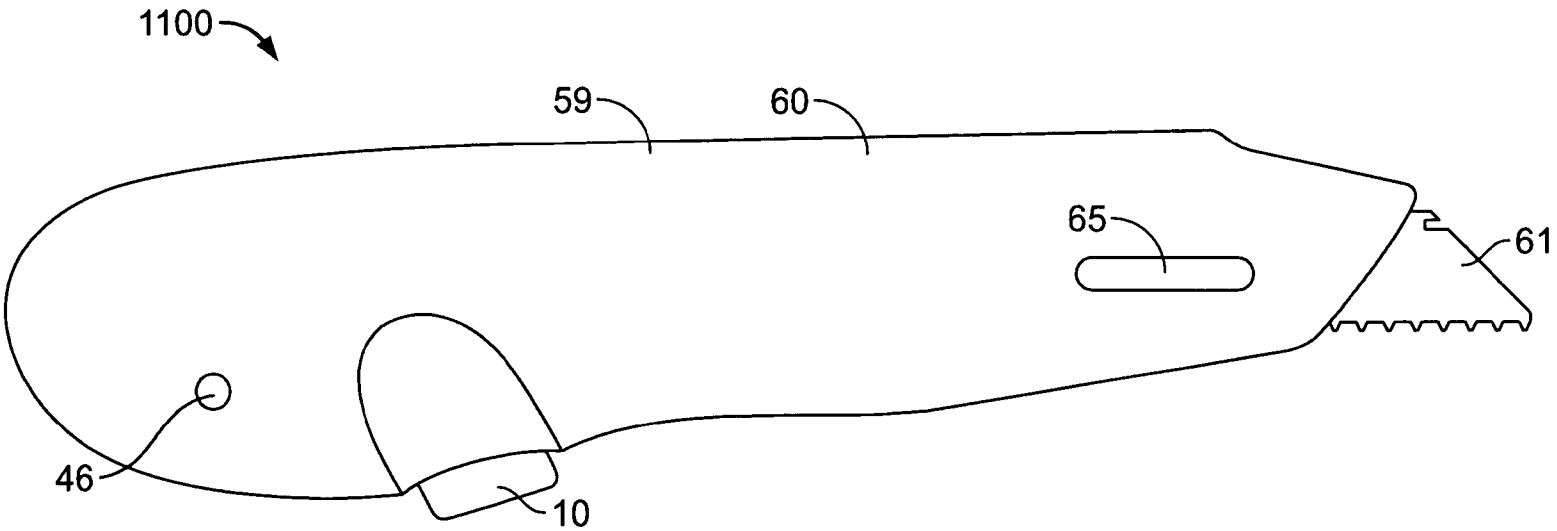
FIG. 41 is a side view of a powered utility knife of the disclosure having a fixed (non-retractable) blade carrier and blade.

Referring to FIG. 41, an alternative powered utility knife 1100 of the disclosure has a nonretractable blade. Knife housing 59 has blade 61 extending through blade opening 109 at the front end of knife housing 59. Power switch 10, when pressed and held inward, actuates the motor to shuttle carrier and blade 61 rapidly back and forth in cutting motion. Blade changing is accomplished by pressing blade release button 65, which releases blade 61 so it can manually be pulled out of the front of knife housing 59 through blade opening 109. Release button 65 is also connected to safety switch 76, mounted on bracket 102. The safety switch interrupts the electrical circuit when release button 65 is pressed inward. After removal, the blade 61 can be either turned end-for-end to expose a new cutting edge or it can be replaced with a new blade. The blade is inserted through blade opening 109 and engaged and locked by blade support 64.

Figure 42:
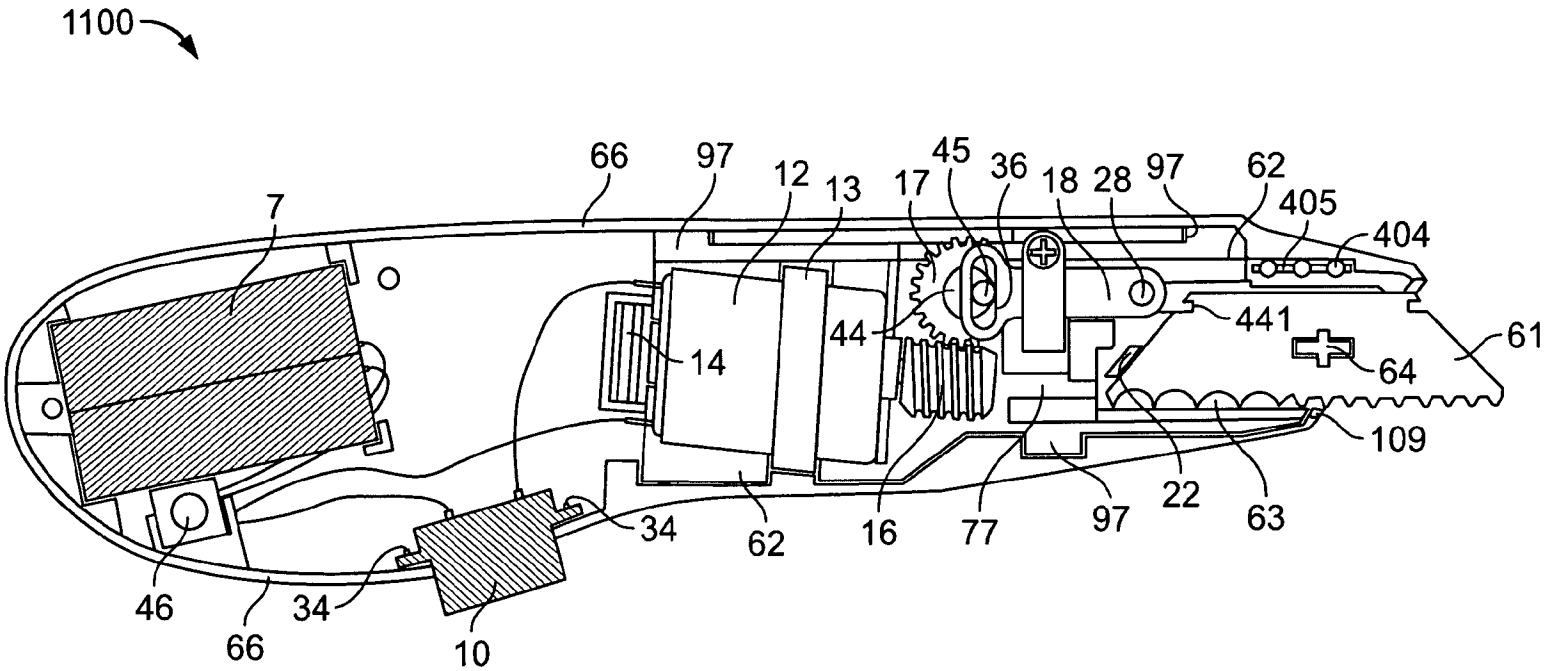
FIG. 42 is a side section view of the powered utility knife of FIG. 41 having a fixed (non-retractable) blade.

As shown in FIG. 42, the fixed shuttle plate is fastened to the utility knife is fastened to case left portion 66 and case right portion 60 by shuttle plate anchor points 97. The drive system may be as described above. The shuttle plate 62 is fixed in one position while the motor-driven components shuttle carrier 63 rapidly back and forth on fixed shuttle plate guide rails 77 in powered cutting motion.

Figure 43:
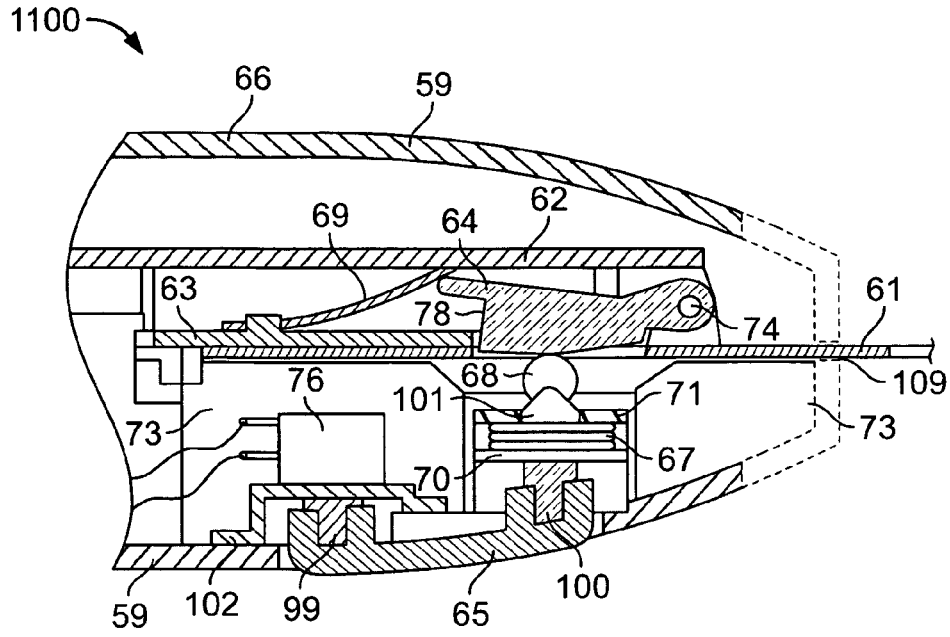
FIGS. 43 and 44 are top section views of the powered utility knife of FIG. 41, with the blade release button depressed and with the blade release button returned to normal operating position, respectively.
Figure 44:
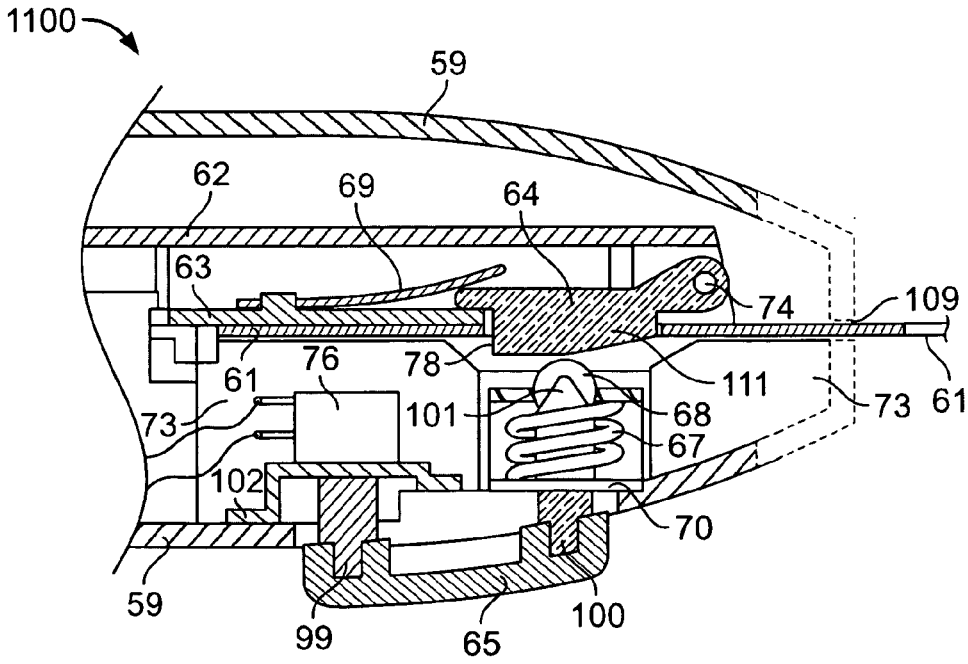

FIGS. 43 and 44 illustrate the simultaneous function of release button 65 with power disconnect safety switch and the blade release assembly, which is shown in the circuit breaking and blade removal modes respectively. Blade support 64 is long enough to so that release wheel 68 makes proper contact with blade support 64 when carrier is at both forward and rearward limit of power driven shuttle stroke.

In FIG. 43, release button 65 is pressed inward, moving blade support 64 back by pivoting on blade support pivot pin 74. Rotation of release wheel 68 on wheel support 101 allows blade 61 to slide between the wheel and support 64 when blade 61 is pulled out of the front of knife housing 59 through blade opening 109. Release button 65 is attached to switch plunger 99 of safety switch 76 and release shaft 100 attached to spring compressor 70. Safety switch 76 is shown in the circuit breaking position while blade 61 is being removed or inserted. Safety switch 76 interrupts any power that may have been inadvertently actuated while blade 61 is being removed or inserted.

In FIG. 44, button spring 67 has returned blade changing release button 65 and safety switch 76 to their normal operating positions. Support spring 69 returns support 64 back to its normal position to lock blade 61 in place on carrier 63. Support pusher 78 urges blade in rearward direction, and side engager 441 and middle blade pusher 22 urge the blade in a forward direction during cutting. Safety switch 76, shown in circuit connected position, is wired directly to battery 7. Carrier 63 shuttles back and forth on shuttle plate guide rails 77 and shuttle plate channel 108 in powered cutting motion.

Figure 45:
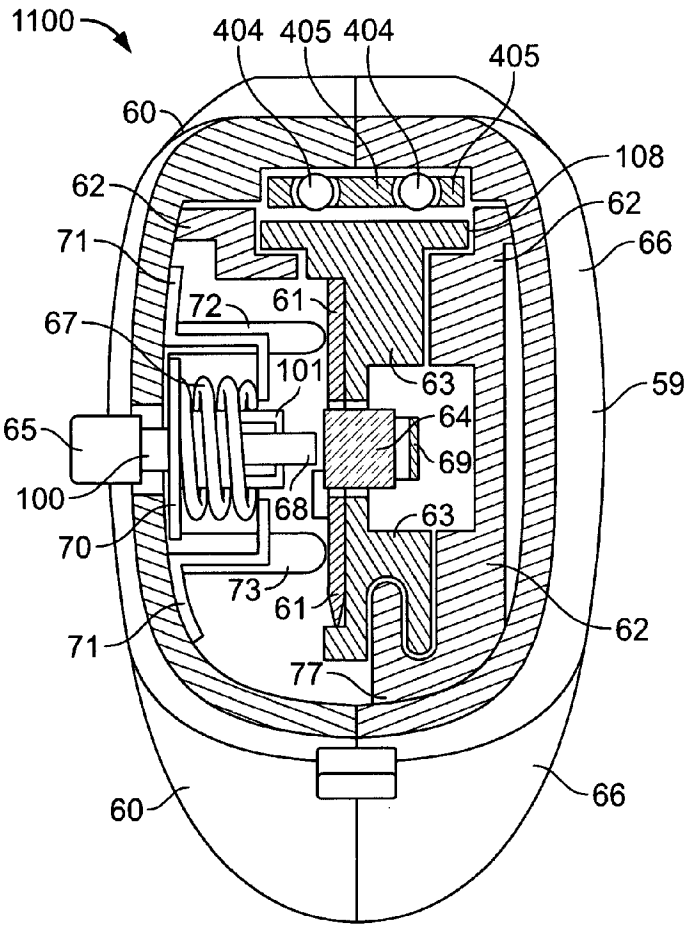

In FIG. 45, release button 65 is shown in normal operating position. Blade 61 is locked in place by blade support 64, which is held in position by support spring 69. Upper support rib 72 and lower support rib 73 hold blade 61 securely against carrier 63. Release button 65 is attached to release shaft 100, which is attached to spring compressor 70. Button spring 67 moves spring compressor 70 outwards, moving release button 65 and release wheel 68 away from blade support 64 for normal operating mode.

Figure 46:
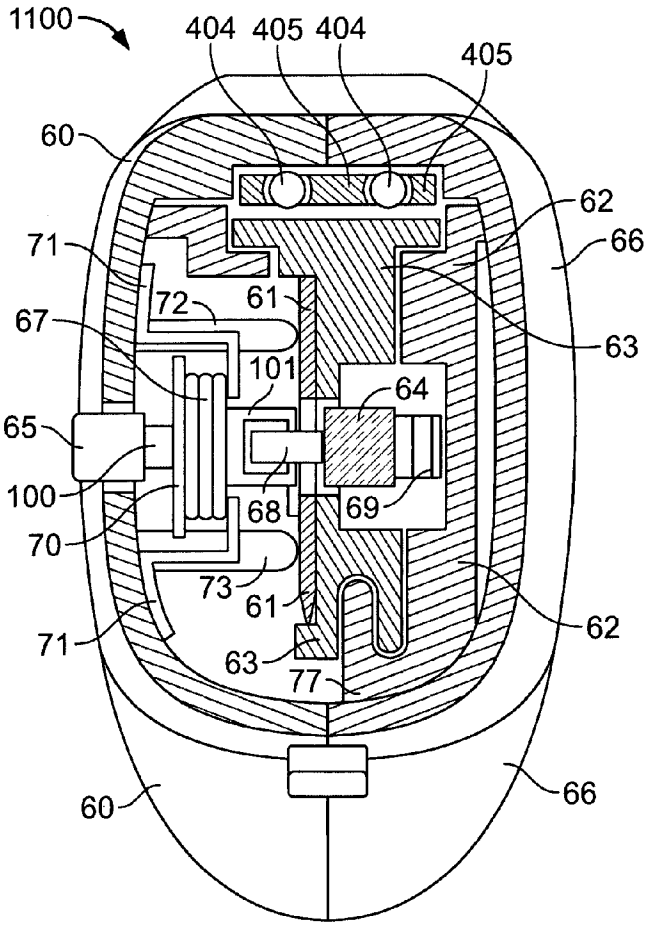
FIGS. 45 and 46 are end section views of the powered utility knife of FIG. 41, with the blade release button depressed, as in FIG. 43, and with the blade release button returned to normal operating position, as in FIG. 44, respectively.

In FIG. 46, release button 65 is shown pressed inward to release the blade for removal and to insert a blade. Release button 65 is pressed inward, displacing blade support 64 so that blade 61 can be pulled out of, or inserted into, knife housing 59. Release wheel 68 rotates, allowing blade 61 to slide between the wheel and blade support 64. When button 65 is released, spring 67 pushes up against button spring compressor 70, returning release button back to normal position. Spring bracket 71, containing spring 67, is attached to knife case right portion 60. Alternative release mechanisms may be employed; for example, release button 65 may be replaced with a button that slides over switch plunger 99 and release shaft 100 to realize an equivalent mechanical action.

A series of ball bearings 404 in ball bearing cage 405 allow carrier 63 to operate efficiently with minimal friction when carrier 63 is articulating back and forth in the powered cutting mode, even when considerable force is applied to the knife blade 61 during cutting. Force applied to the knife housing is transmitted to ball bearings 404 in ball bearing cage 405 riding between the top of reciprocating carrier 63 and the underside of knife case left portion 66 and knife case right portion 60, to permit the carrier 63 to easily roll back and forth while in the powered cutting mode.

Figure 47:
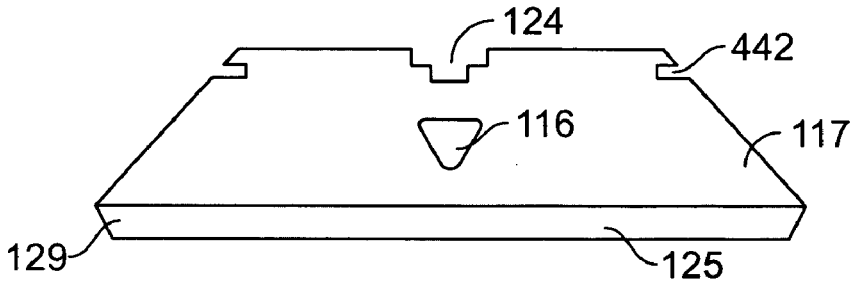
FIGS. 47 to 53 are side plan views of other implementations of utility knife blade configurations for use in powered utility knives of the disclosure.

Additional blade embodiments are shown in FIGS. 47 to 53 (with reference to the carrier shown in FIGS. 4 and 5):

In FIG. 47, preferred blade 117 has a sharp cutting edge 125 along the bottom edge. The sharp angled ends 129 of the blade 117 enable the reciprocating blade 117 to make a smooth entry into the material being cut. To aid in keeping the blade 117 firmly aligned on carrier 32 during its rapid powered shuttling back and forth, each blade defines an upper blade notch 124 that engages upper blade engager 26, a loading assist opening 116 that engages preferred loading assist 25, and a notch 442 that receives side engager 441.

Figure 48:
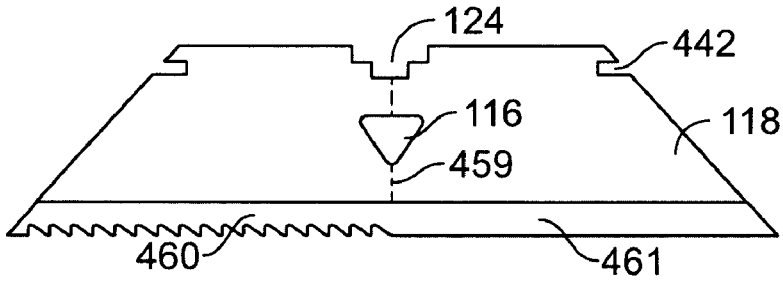

In FIG. 48, preferred blade 118 has two different details on each side of centerline 459 angled saw teeth 460 and straight sharp edge 461. To aid in keeping the blade 118 firmly aligned on carrier 32 during its rapid powered shuttling back and forth, each blade defines an upper blade notch 124 that engages preferred upper blade engager 26, a loading assist opening 116 that engages loading assist 25, and a notch 442 that receives side engager 441.

Figure 49:
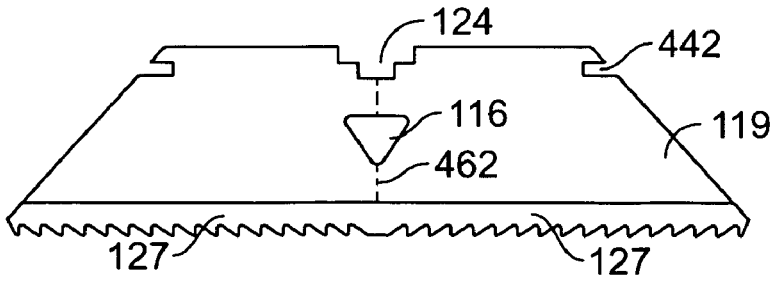

In FIG. 49, preferred blade 119 defines sharp teeth 127 along the bottom edge. The tooth design of the teeth 127 is configured in such a manner that the aggressive cutting edge of each tooth is always facing inward during its articulating cutting stroke. This is achieved by having a mirror image of the tooth profiled on each side of a centerline 462 of the blade 119. When the blade 119 is rotated to utilize the unused half of the blade 119, the aggressive cutting edge of the teeth 127 are again facing inward during the cutting stroke. To aid in keeping the blade 119 firmly aligned on carrier 32 during its rapid powered shuttling back and forth, each blade defines an upper blade notch 124 that engages upper blade engager 26, a loading assist opening 116 that engages loading assist 25, and a notch 442 that receives side engager 441.

Figure 50:
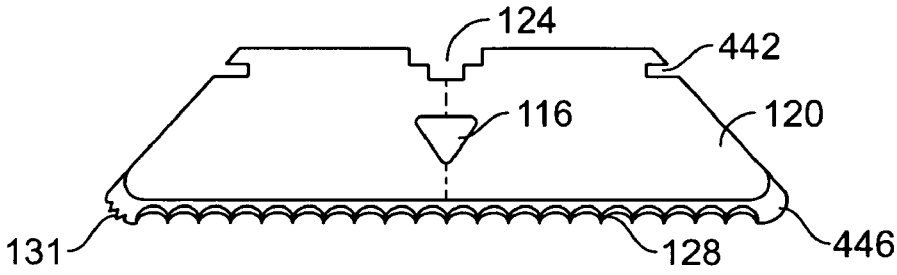

In FIG. 50, a preferred blade 120 defines a sharp serrated detail 128 along a bottom edge. The angled end with sharp teeth 131 and sharp rounded end 446 of the blade 120 enable the reciprocating blade 120 to make a smooth entry into the material being cut. To aid in keeping the blade 120 firmly aligned on carrier 32 during its rapid powered shuttling back and forth, each blade defines an upper blade notch 124 that engages upper blade engager 26, a notch 442 that receives side engager 441, and a loading assist opening 116 that engages preferred loading assist 25.

Figure 51:
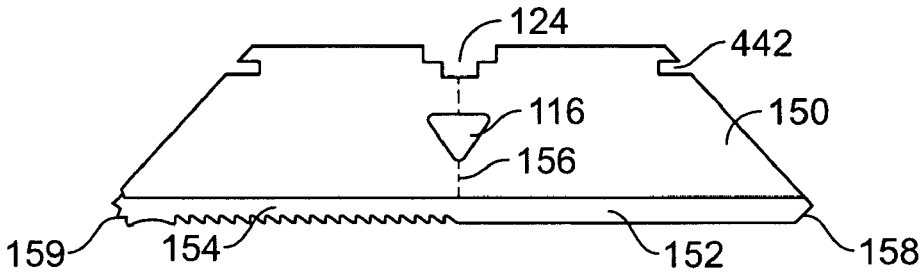

In FIG. 51, a preferred blade 150 defines a bottom with two different details 152, 154 on each side of a centerline 156 the straight sharp bottom edge 152 and saw teeth 154 with sharp angled end 158, and sharp angled end with sharp teeth 159. To aid in keeping the blade 150 firmly aligned on carrier 32 during its rapid powered shuttling back and forth, each blade defines an upper blade notch 124 that engages upper blade engager 26, a notch 442 that receives side engager 441, and a loading assist opening 116 that engages preferred loading assist 25.

Figure 52:
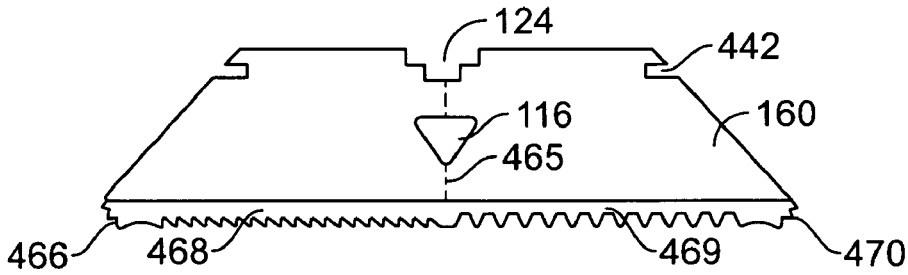

In FIG. 52, a preferred blade edge 160 defines two different details on each side of centerline 465 angled saw teeth 468 and coarse teeth 469 with angled, ends 466 and 470 containing saw teeth. To aid in keeping the blade 160 firmly aligned on carrier 32 during its rapid powered shuttling back and forth, each blade defines an upper blade notch 124 that engages upper blade engager 26, a notch 442 that receives side engager 441, and a loading assist opening 116 that engages loading assist 25.

Figure 53:
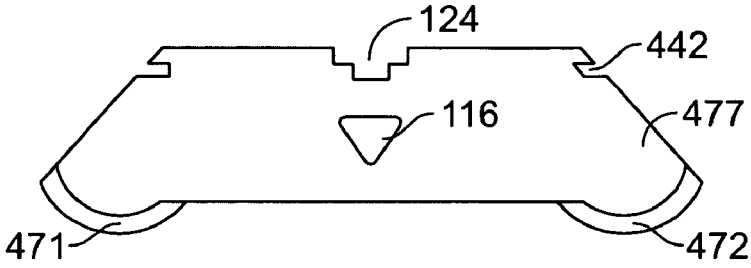

In FIG. 53, a preferred blade 477 defines a semicircular cutting edge 471 and 472 at each end. To aid in keeping blades 447 firmly aligned on carrier 32 during its rapid powered shuttling back and forth, each blade defines an upper blade notch 124 that engages preferred upper blade engager 26, a notch 442 that receives side engager 441, and loading assist opening 116 that engages loading assist 25.

Figure 54:
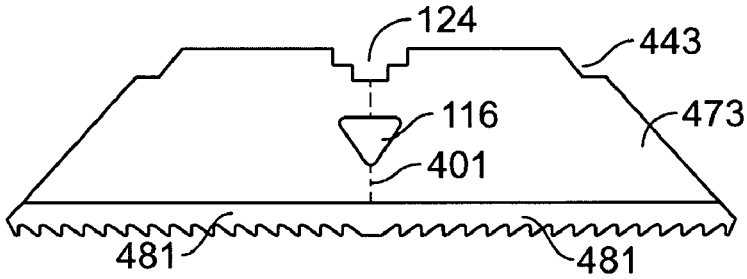
FIGS. 54 to 57 are side plan views of still other implementations of utility knife blade configurations for use in powered utility knives of the disclosure.
Figure 54A:
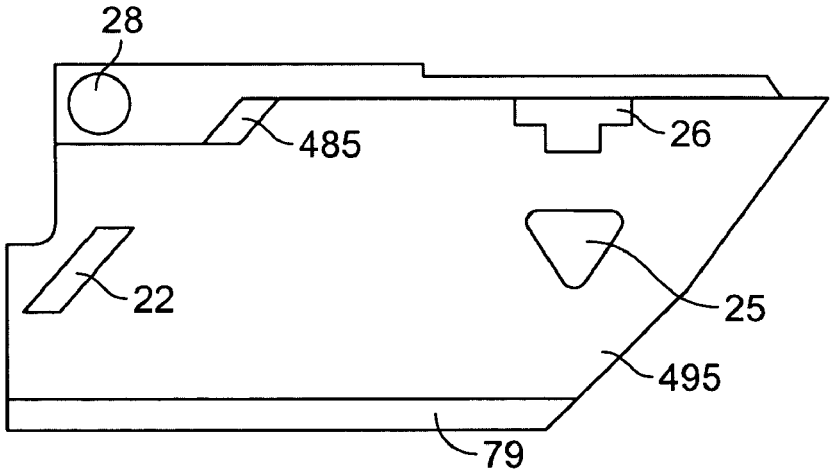

In FIG. 54, utility knife blade 473 defines a blade edge with sharp teeth 481 along the bottom edge. The tooth design of the teeth 481 is configured in such a manner that the aggressive cutting edge of each tooth is always facing inward during its articulating cutting stroke. This is achieved by providing a mirror image of the tooth profiled on each side of a centerline 401 of the blade 473. When the blade 473 is rotated to utilize the unused half of the blade 473, the aggressive cutting edge of the teeth 481 are again facing inward during the cutting stroke. To aid in keeping the blades 473 firmly aligned on carrier 495 during its rapid powered shuttling back and forth, each blade defines an upper blade notch 124 that engages upper blade engager 26, loading assist opening 116 that engages loading assist 25, and corner notch 443 that engages corner notch engager 485. Referring to FIG. 54A, a utility knife blade carrier 495 is configured for receiving utility knife blade 473. In particular, carrier 495 has a corner notch engager 485 configured and positioned to engage corner notch 443 of utility knife blade 473.

Figure 55:
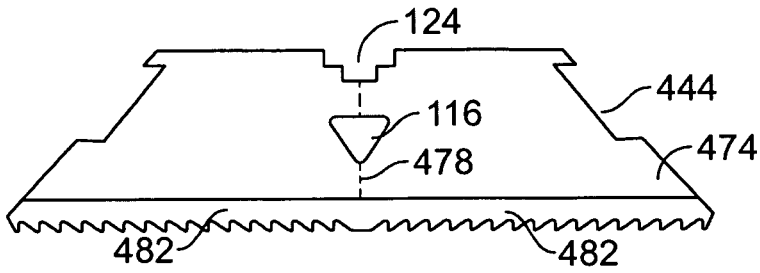
Figure 55A:
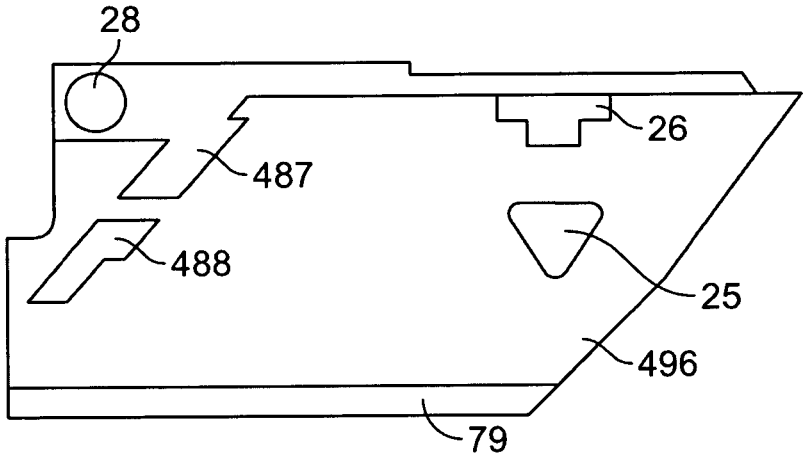

In FIG. 55, utility knife blade 474 has sharp teeth 482 along the bottom edge. The tooth design of the teeth 482 is configured in such a manner that the aggressive cutting edge of each tooth is always facing inward during its articulating cutting stroke. This is achieved by providing a mirror image of the tooth profiled on each side of a centerline of the blade 474. When the blade 474 is rotated to utilize the unused half of the blade 474, the aggressive cutting edge of the teeth 482 are again facing inward during the cutting stroke. To aid in keeping the blades 474 firmly aligned on carrier 496 during its rapid powered shuttling back and forth, each blade defines an upper blade notch 124 that engages upper blade engager 26, a loading assist opening 116 that engages preferred loading assist 25, long side notch 444 that engages upper side notch engager 487 and lower side notch engager 488 (FIG. 55A). Referring further to FIG. 55A, a utility knife blade carrier 496 is configured for receiving utility knife blade 474. In particular, carrier 496 has an upper side engager 487 and a lower side engager 488 configured and positioned to engage long side notch 444 of utility knife blade 474.

Figure 56:
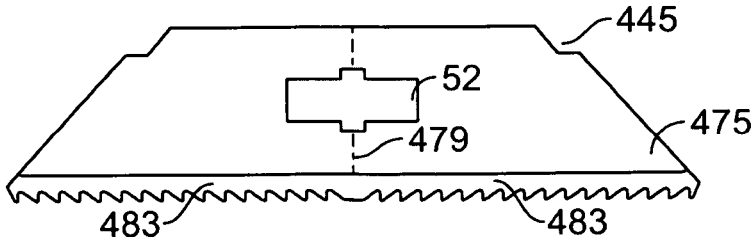
Figure 56A:
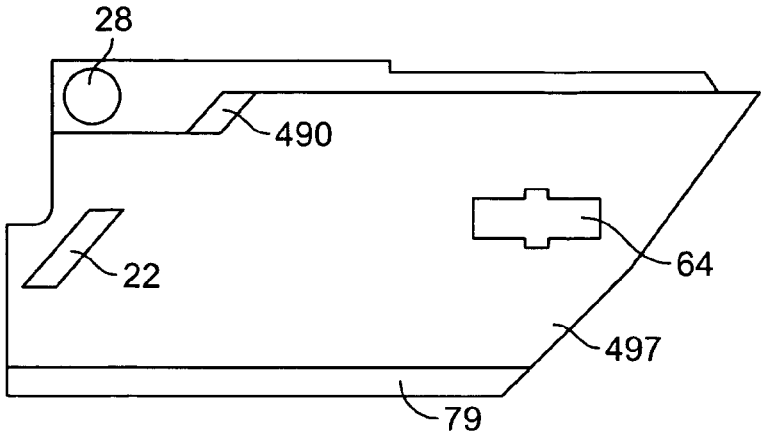

In FIG. 56, utility knife blade 475 has sharp teeth 483 defined along the bottom edge. The tooth design of the teeth 483 is configured in such a manner that the aggressive cutting edge of each tooth is always facing inward during its articulating cutting stroke. This is achieved by providing a mirror image of the tooth profiled on each side of a centerline 479 of the blade 475. When the blade 475 is rotated to utilize the unused half of the blade 475, the aggressive cutting edge of the teeth 483 are again facing inward during the cutting stroke. To aid in keeping the blades 475 firmly aligned on carrier 497 during its rapid powered shuttling back and forth, each blade defines a load assist opening 52 that receives blade load assist 64, and a corner notch 445 that engages corner notch engager 490 (FIG. 56A). Referring further to FIG. 56A, a utility knife blade carrier 497 is configured for receiving utility knife blade 475. In particular, carrier 497 has a corner notch engager 408 configured and positioned to engage corner notch 445 of utility knife blade 475.

Figure 57:
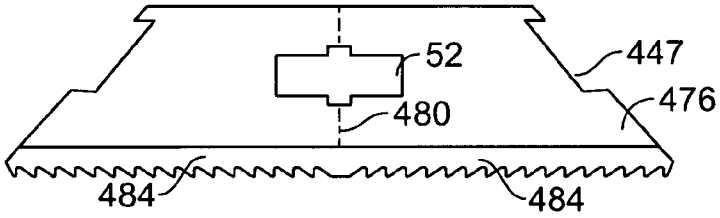
Figure 57A:
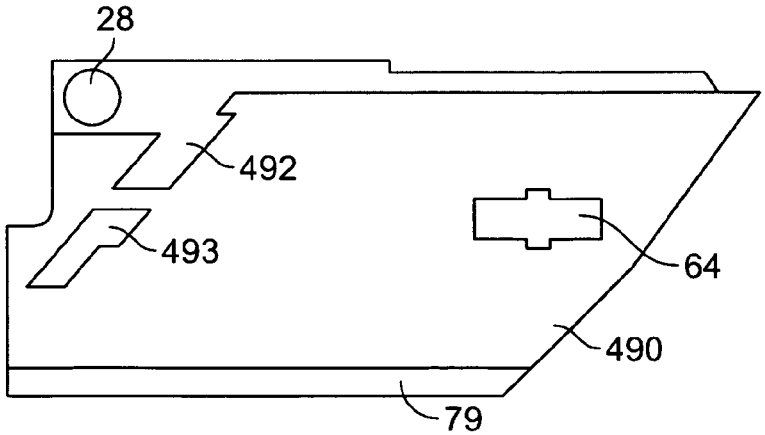

In FIG. 57, utility knife blade 476 defines sharp teeth 484 along the bottom edge. The tooth design of the teeth 484 is configured in such a manner that the aggressive cutting edge of each tooth is always facing inward during its articulating cutting stroke. This is achieved by providing a mirror image of the tooth profiled on each side of a centerline of the blade 476. When the blade 476 is rotated to utilize the unused half of the blade 476, the aggressive cutting edge of the teeth 484 are again facing inward during the cutting stroke. To aid in keeping the blades 476 firmly aligned on carrier 490 during its rapid powered shuttling back and forth, each blade defines a load assist opening 52 that receives a blade load assist 64, and a long side notch 447 that engages an upper side notch engager 492 and a lower side notch engager 493 (FIG. 57A). Referring further to FIG. 57A, a utility knife blade carrier 490 is configured for receiving utility knife blade 476. In particular, carrier 490 has an upper side engager 492 and a lower side engager 493 configured and positioned to engage long side notch 447 of utility knife blade 476.

Figure 58:
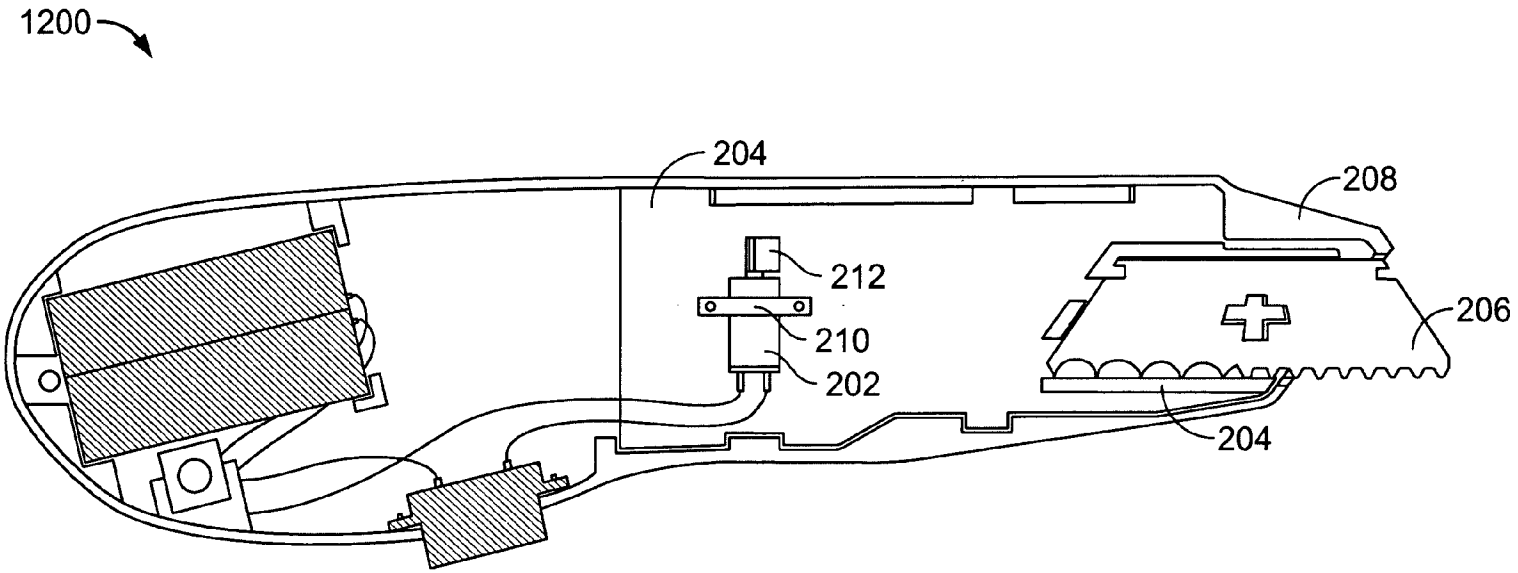
Figure 60:
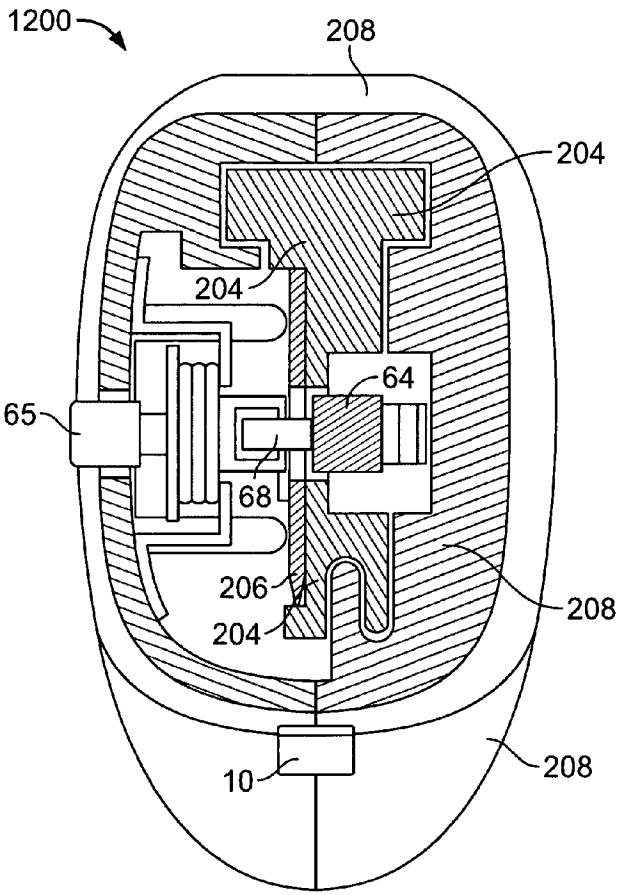
FIGS. 59 and 60 are end section views with the blade support locking the utility blade in place, and with the blade support in position for blade removal, respectively.
Figure 59:
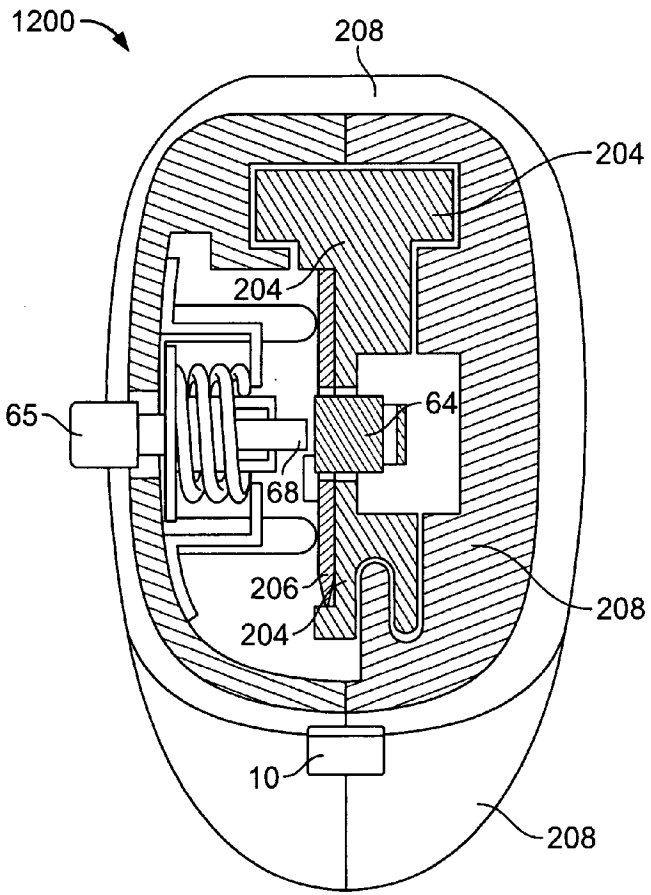

Referring now to FIGS. 58, 59 and 60, in another implementation of a powered utility knife 1200 of this disclosure, the utility knife blade 206 is caused to vibrate in an effective cutting fashion by means of a vibrating motor 202. Utility knife 1200 has many of the features described above. In addition, shuttle plate 204 is maintained in fixed position and the blade 206 is non-retractable relative to the utility knife housing 208. The vibrating motor 202 is secured to the fixed motor plate 204, e.g., by a motor bracket assembly 210. The vibrating motor 202 may include a counterweight 212. In FIGS. 59 and 60, the non-retractable blade 206 is shown in end section views with release wheel 68 and blade support 64 locking the blade in place (FIG. 59) and with the release wheel 68 and blade support 64 in position to remove or insert the blade (FIG. 60). This mechanism has been described in more detail above, with reference to FIGS. 42 to 45.

Figure 61:
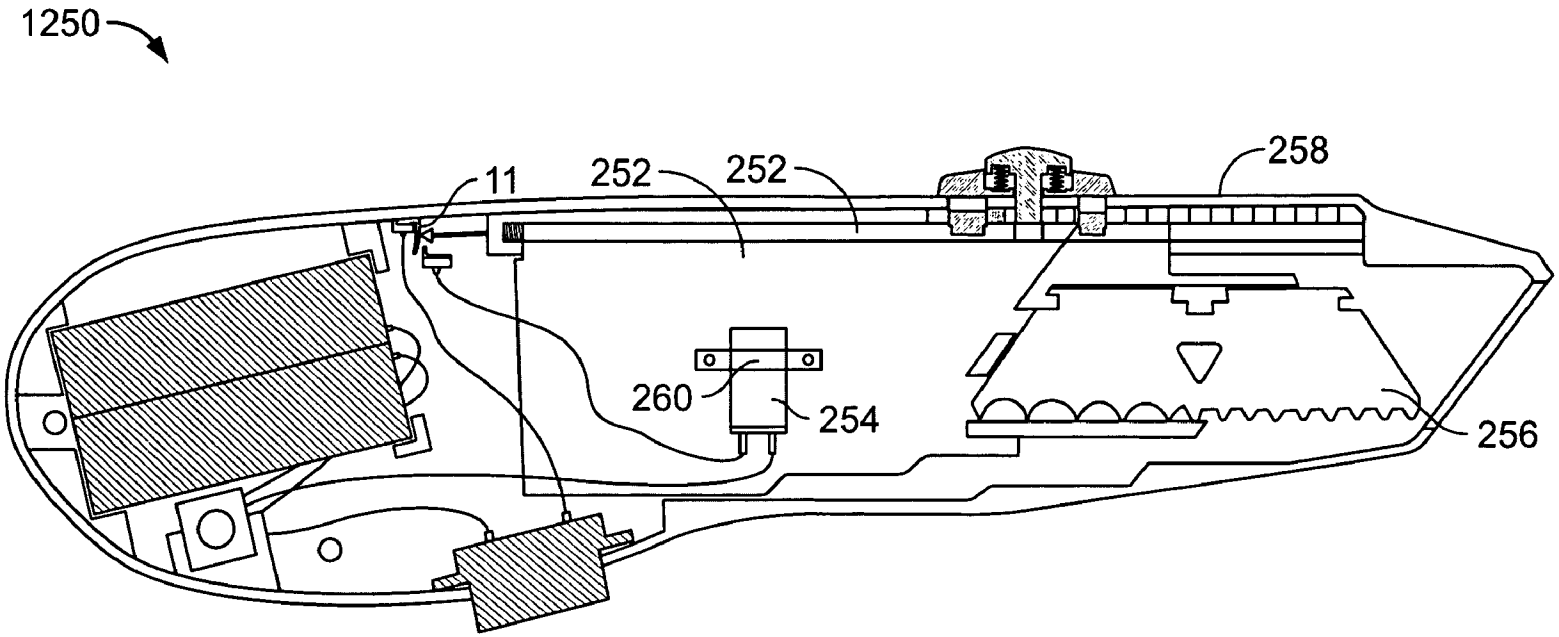
FIGS. 61 and 62 are side section views of still another implementation of a powered utility knife of the disclosure, in which a moveable (retractable) blade is driven in a vibrating cutting action, with the blade shown retracted (FIG. 61) and extended (FIG. 62)
Figure 62:
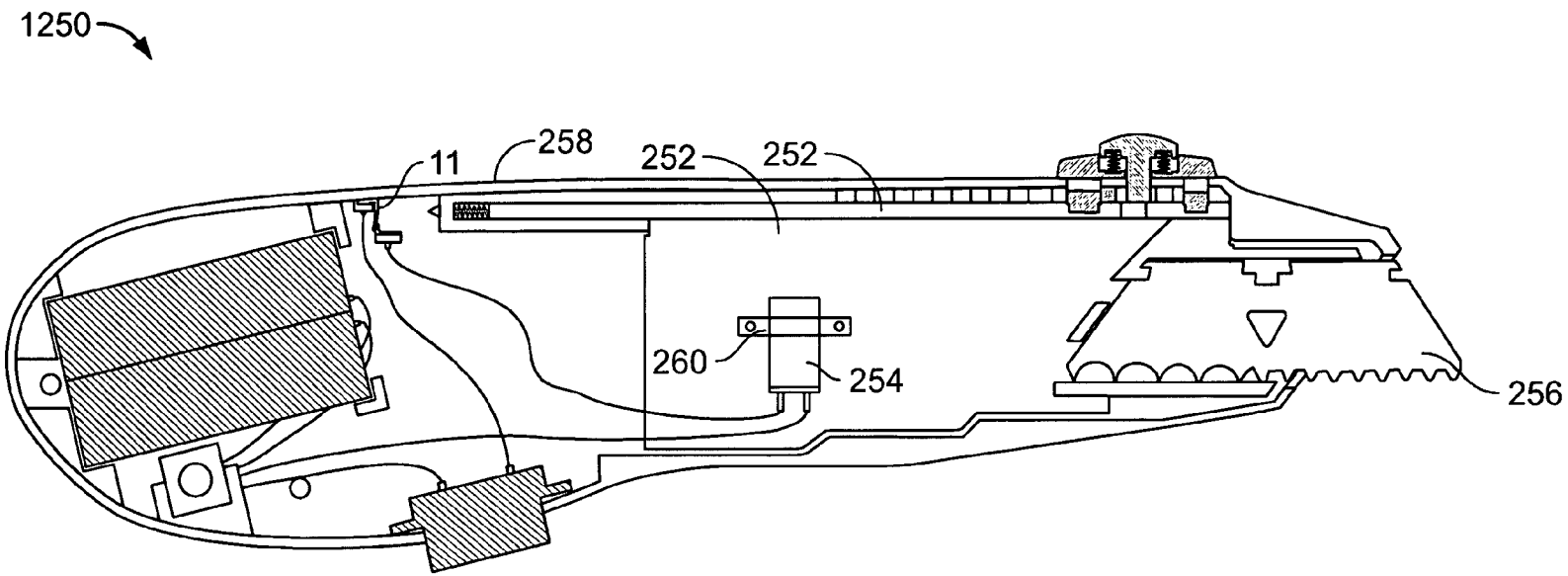
Figure 63:
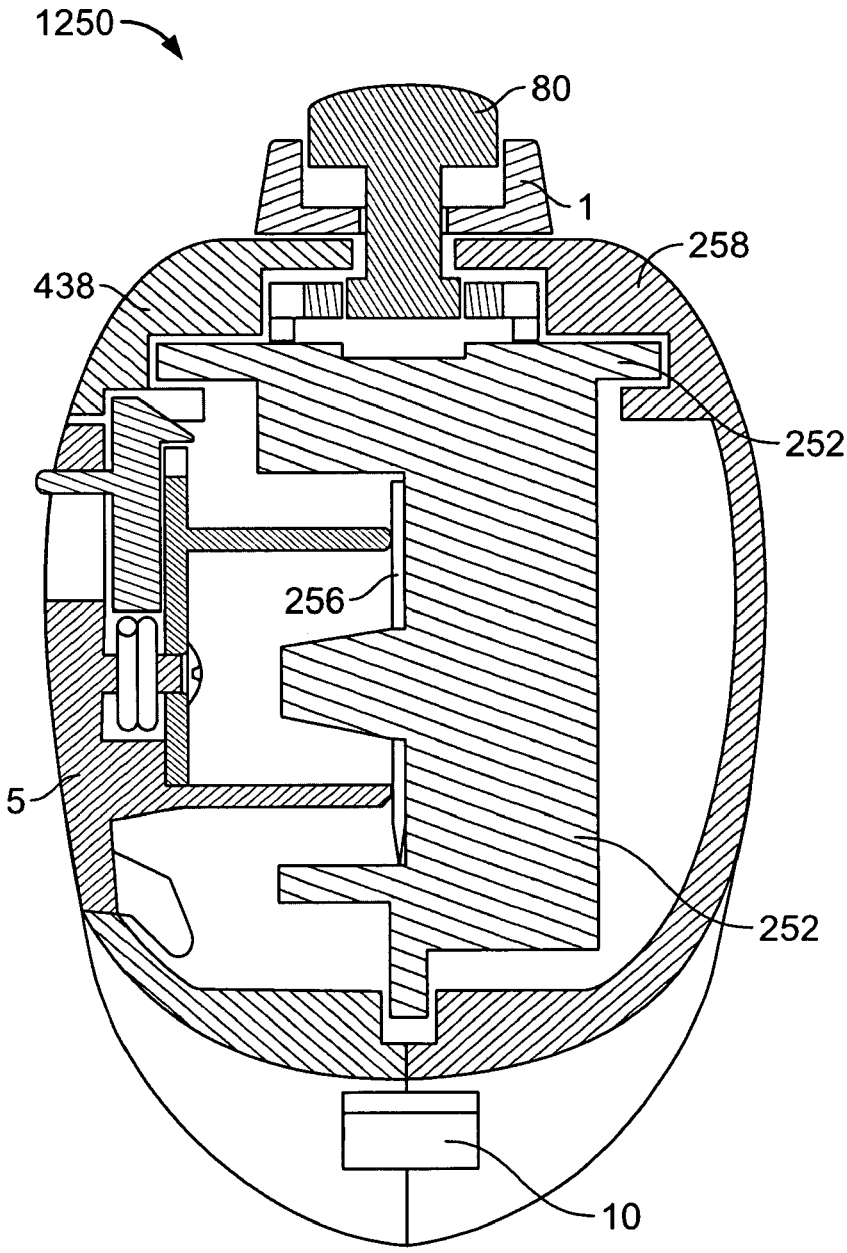
FIG. 63 is an end section view of the retractable blade mechanism.
Figure 65:
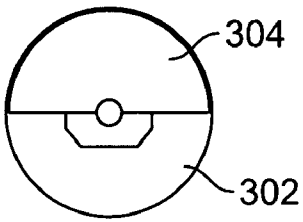
FIG. 65 is a top view of the motor assembly of FIG. 64.
Figure 64:
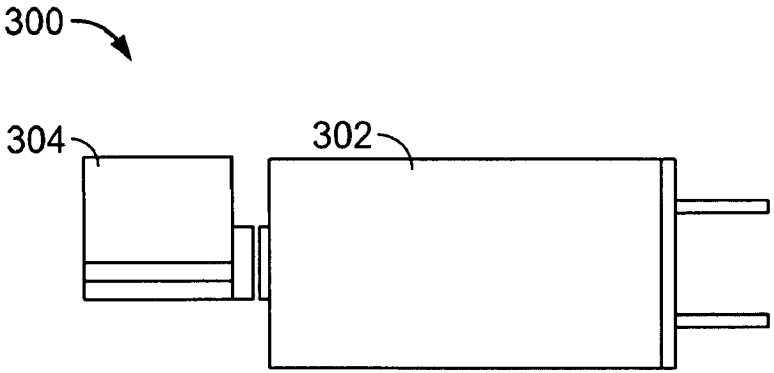
FIG. 64 is a side view of a motor assembly for a powered utility knife of the disclosure.
Figure 66:
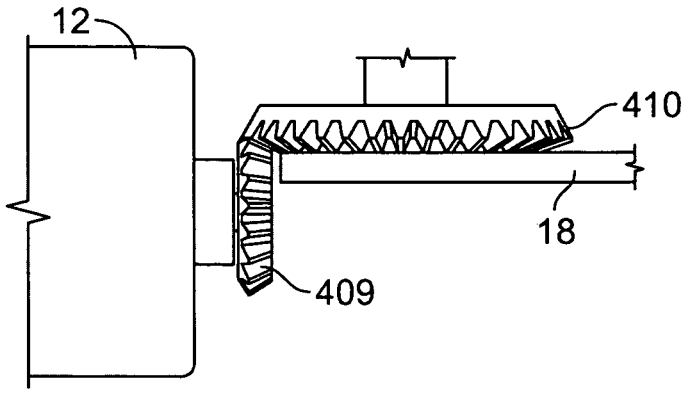
FIGS. 66 and 67 are side and top views, respectively, of a bevel gear drive assembly for a powered utility knife of the disclosure.
Figure 67:
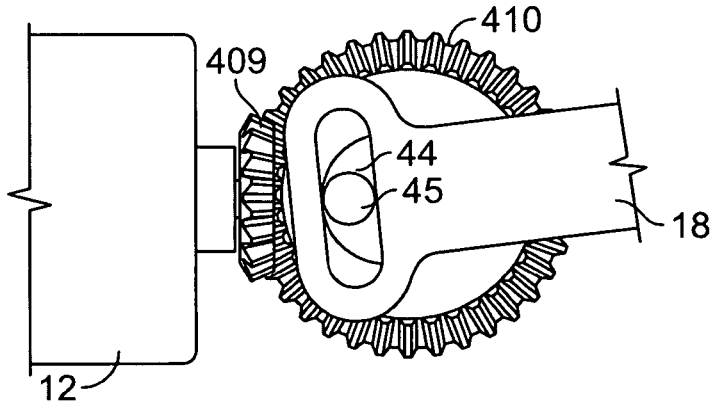
Figure 68:
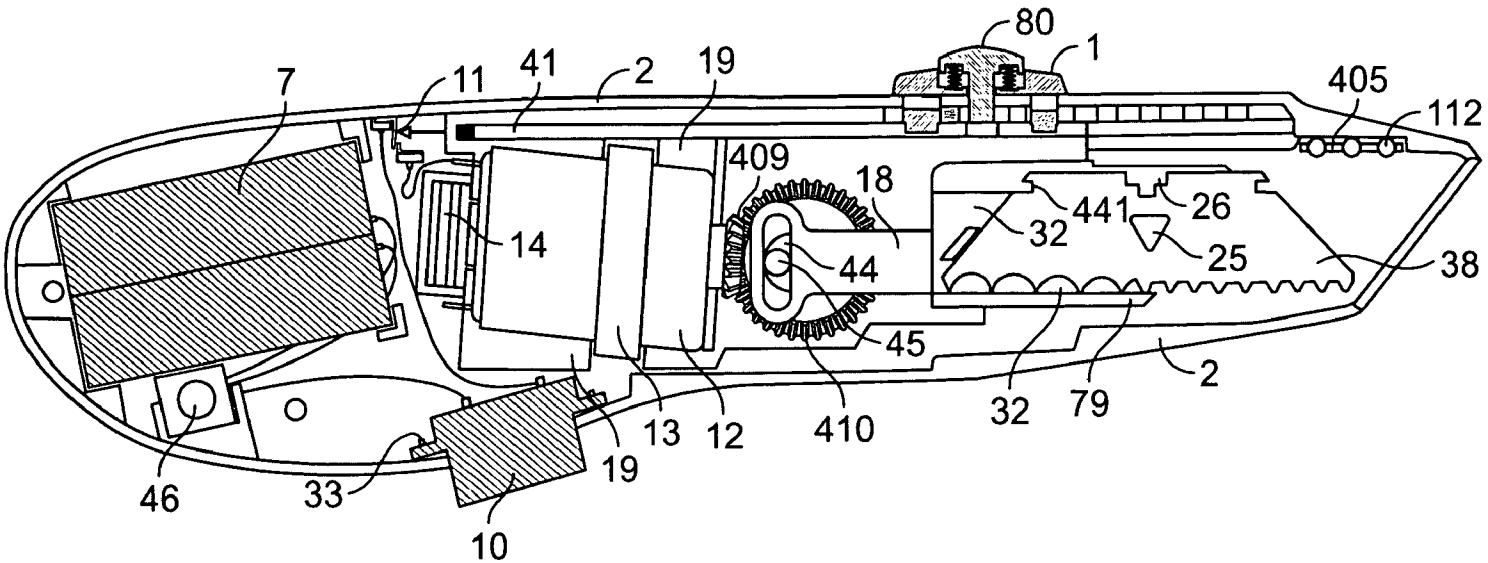
FIGS. 68 and 69 are side section views of a powered utility knife of the disclosure equipped with a bevel gear drive assembly and a retractable utility knife blade, showing the blade in retracted position and in extended position, respectively.
Figure 69:
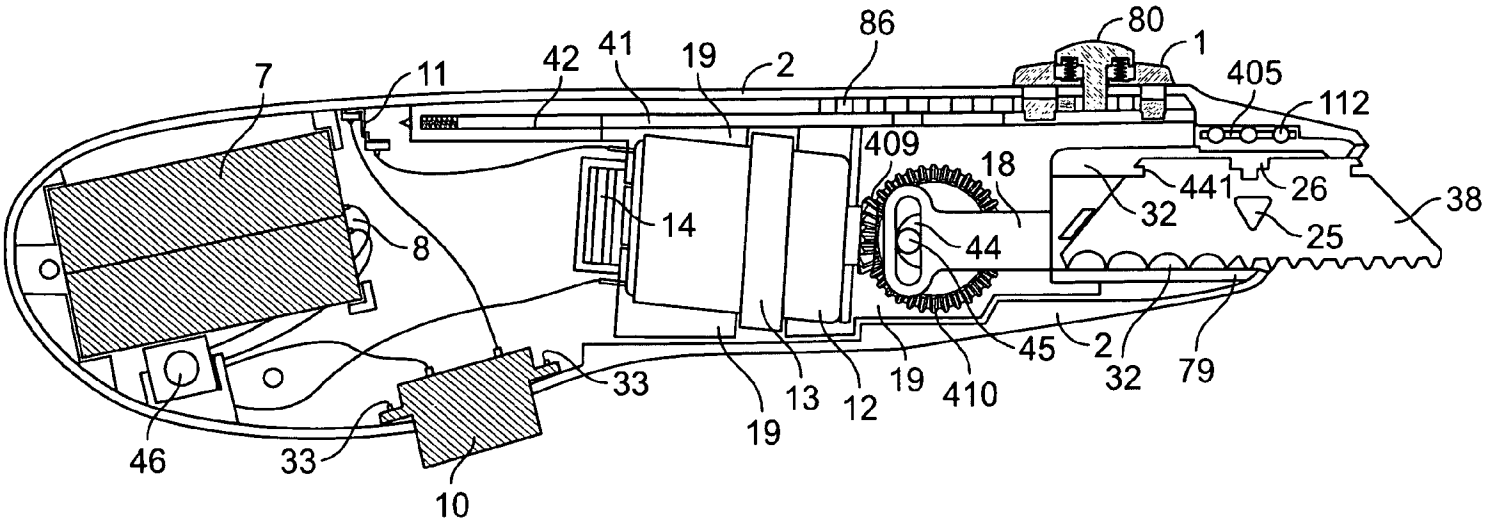

In another implementation, shown in FIGS. 61, 62 and 63, a powered utility knife 1250 of the disclosure having a utility knife blade that is caused to vibrate in effective cutting fashion has a retractable motor plate 252 and vibrating motor 254. The vibrating motor 254 is secured to the retractable motor plate 252 by a motor bracket assembly 260. The retractable motor plate 252 thus allows manual retraction of the blade 256 into the utility knife housing 258 (FIG. 61) and allows extension of the blade 256 out of the utility knife housing 258 (FIG. 62). The retractable blade mechanism is also shown in end view in FIG. 63. The vibrating utility knife typically would not be equipped with the ball bearing 112 and ball bearing cage 405 assembly described above for support of the reciprocating back and forth cutting motion of the blade. In one particular implementation, the vibrating motor 254 causes an extended blade 256 to vibrate axially as the extended blade 256 is rapidly shuttled back and forth by a drive system (not shown). In one implementation, shown in FIGS. 64 and 65, an exemplary vibrating motor assembly 300 includes a vibrating motor 302 and a counterweight 304.

A number of implementations have been described. Nevertheless, it will be understood that various modifications may be made. For example, the blade change details described with reference to FIGS. 43 and 44 for use in a powered utility knife for a non-retractable blade may be used also in a powered utility knife with a retractable blade.

Figure 70:
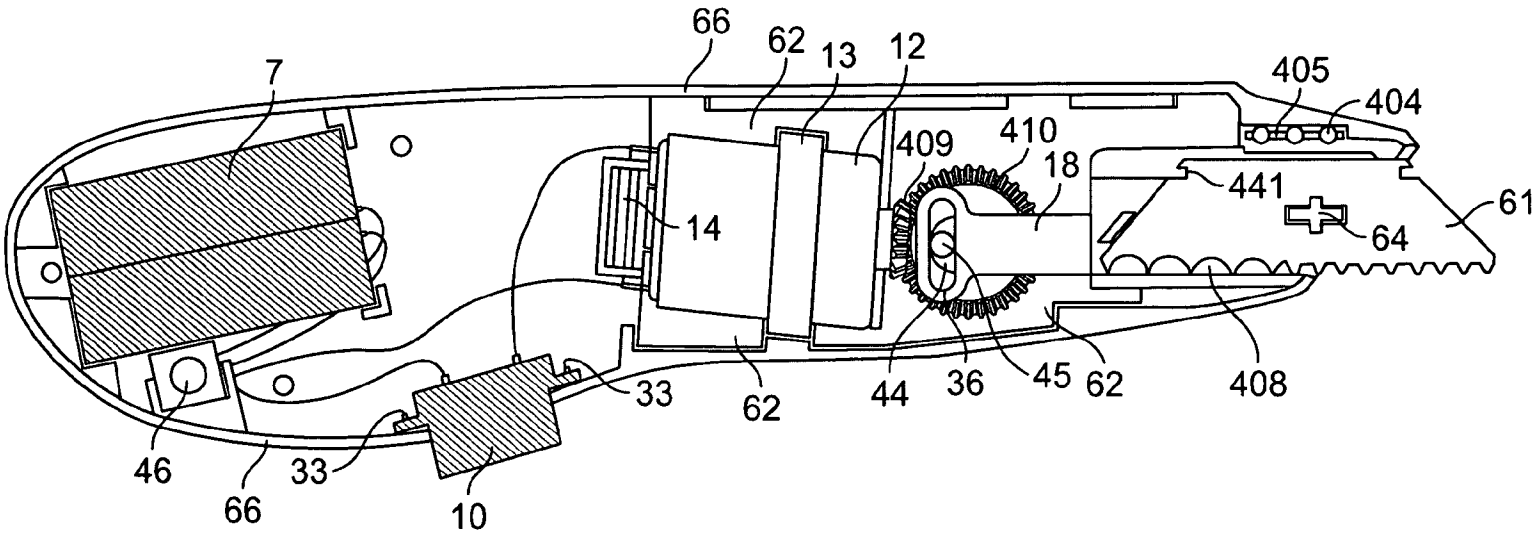
FIG. 70 is a side section view of a powered utility knife of the disclosure equipped with a bevel gear drive assembly and a fixed utility knife blade.

Also, referring to FIGS. 66 to 71, the worm gear drive 16 and driven gear 17, described above with reference, e.g., to FIG. 3, may be replaced with a bevel drive gear 409 and bevel driven gear 410 (FIGS. 66 and 67), including for powered utility knives of the disclosure having a retractable utility knife blade (FIGS. 68 and 69) and for powered utility knives of the disclosure having a fixed utility knife blade (FIG. 70).

Figure 71:
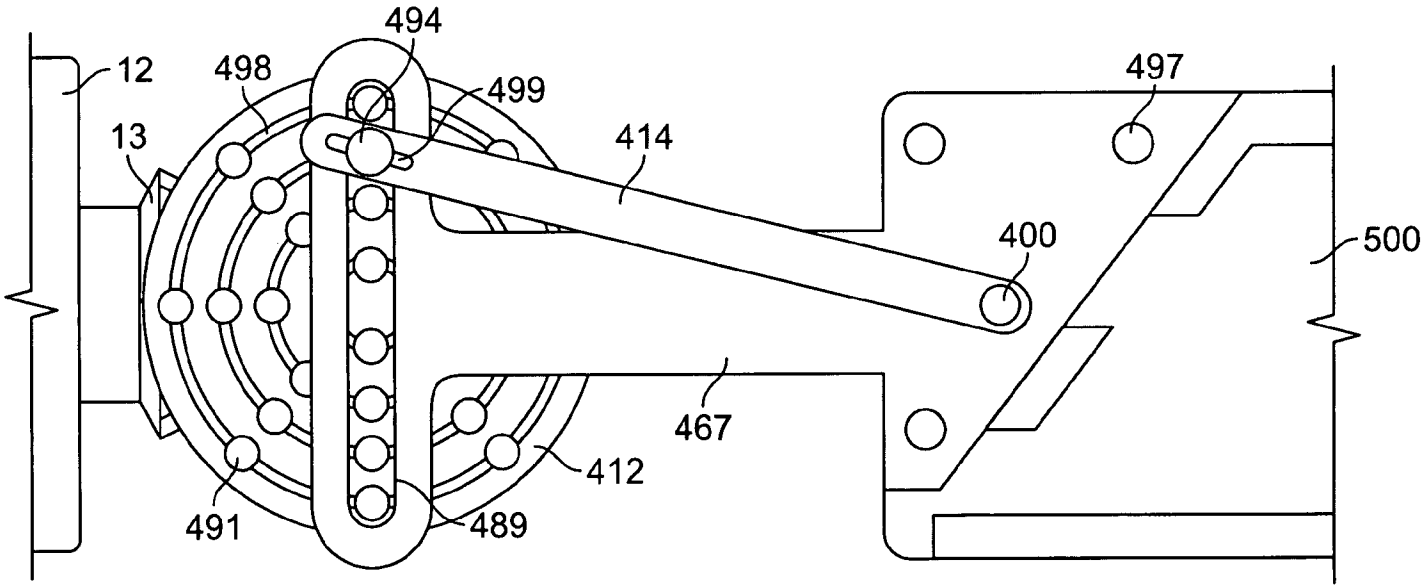
FIG. 71 is a side view and FIG. 72 is a top view of a variable length cutting stroke assembly for a powered utility knife of the disclosure.
Figure 72:
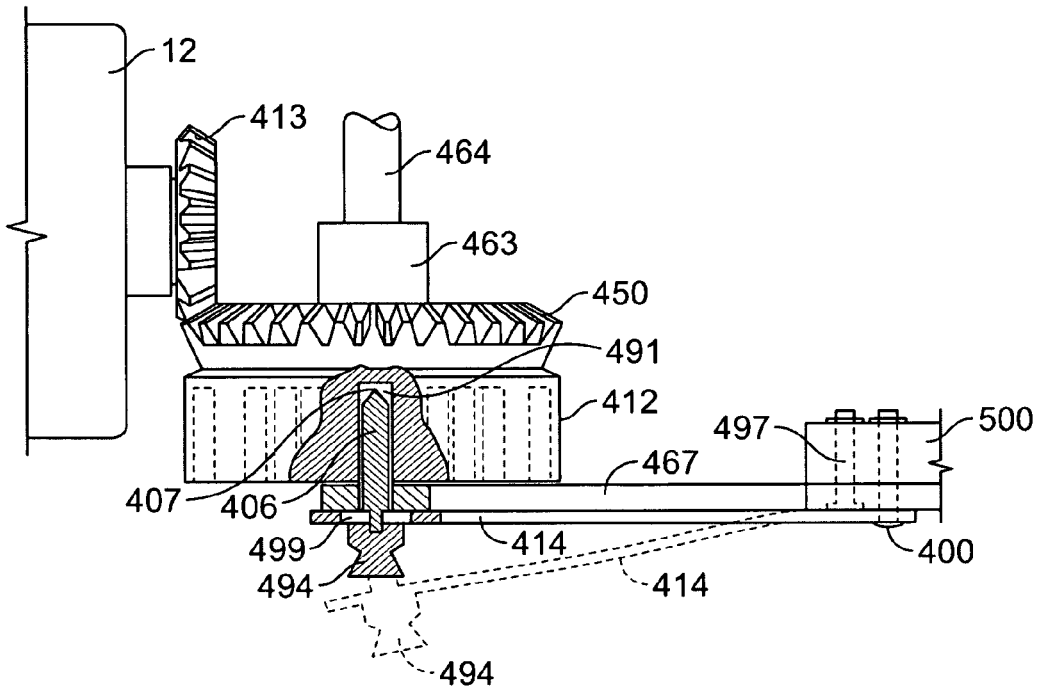

Also, utility knives of the disclosure may be provided with a variable length cutting stroke assembly to allow a user to change the length of the back and forth cutting stroke of the utility knife blade mounted on the blade carrier 500. Referring to FIGS. 71 and 72, motor 12 drives a bevel drive gear 413, which drives a bevel driven gear 450, which is part of stroke selector plate 412 turned by gear 450, mounted by gear hub 463 to rotating shaft 464. Adjustable crank pin 406 can be located in any of a number of different stroke adjustment holes 491 to vary the length of the cutting stroke. Crank pin knob 494 is used to move the crank pin 406 to a desired position within the adjustable cam 489 slot. Spring connector arm 414 springs back when crank pin 406 is pulled out of stroke adjustment hole 491, by means of crank pin knob 494, and rotated on spring connecting arm 414 which pivots on connecting arm pivot pin 400 allowing movement to other adjustment locations within the adjustment cam 489 slot. Crank pin slot 499 allows crank pin knob 494 and crank pin 406 to slide back and forth to accommodate various radial requirements when rotating on spring connecting arm 414. In the event that the stroke adjustment hole is not within an adjustment cam slot 489 opening when adjustment is made, the V-groove follower 407 is positioned on the radial V groove 498 between the desired stroke adjustment holes 491. When motor 12 is started, the stroke selector plate is turned by the driven bevel gear 450 and the V-groove follower 407 follows the V-grove 498 until the desired stroke adjustment hole 491 is rotated under the adjustment cam 489 opening, at which time crank pin 406 is pushed into stroke adjustment hole 491 by spring connecting arm 414, causing adjustment cam 489 to move connection plate 467 back and forth at the desired stroke length. Reducing the cutting stroke length reduces the cutting speed and increases the force applied. Relatively shorter cutting strokes may be used for cutting small detail and/or small parts. Increasing the cutting stroke length increases the cutting speed. Relatively longer cutting stroke may be used in cutting larger and/or thicker work pieces.

Figure 73:
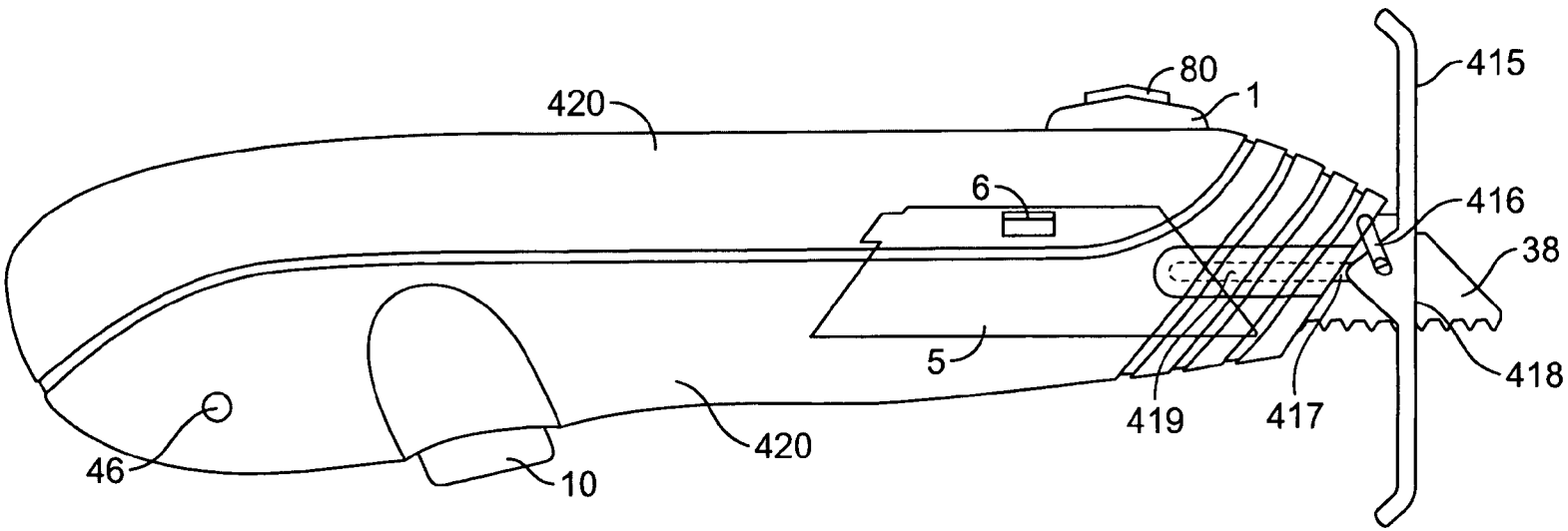
FIGS. 73 and 74 are side views of a powered utility knife of the disclosure equipped with implementations of bracket accessories for steadying and/or aligning the utility knife blade during use.
Figure 74:
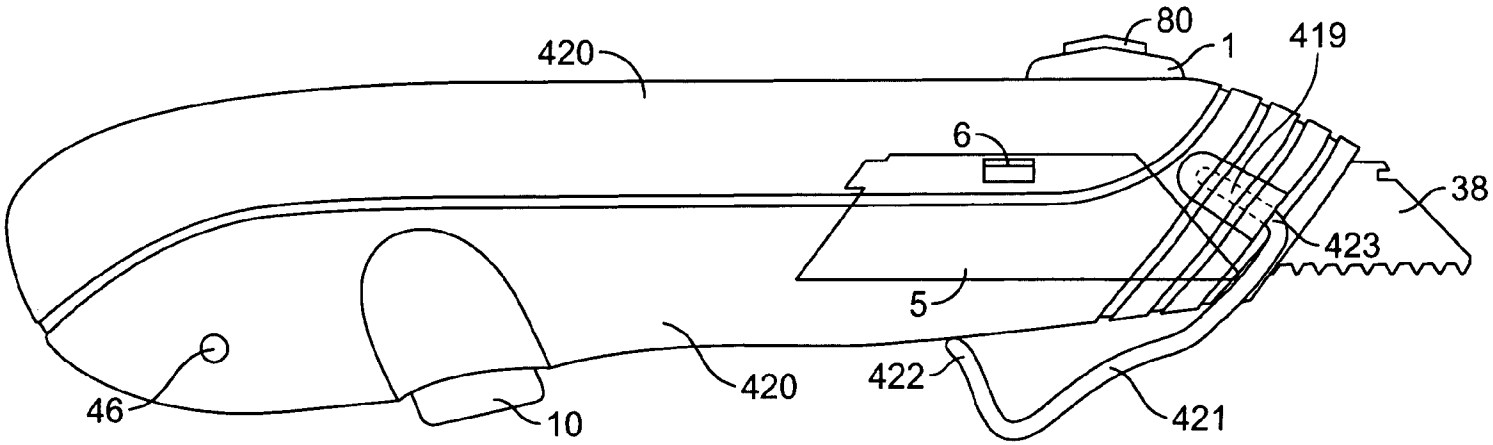

Also, powered utility knives of the disclosure may be provided with accessories in the form of support brackets constructed for mounting to the utility knife housing, e.g. by engagement with pockets provided at each side of the blade opening, for the purpose of steadying or aligning the utility knife and blade for cutting is special situations. Referring to FIG. 73, an adjustable angle steadying bracket 415 defines a blade slot 418 in the center bracket for receiving the blade 38. Adjustable bracket arm supports 417 firmly attach the bracket to the utility knife housing 420 by engagement into support arm pockets 419 on each side of blade 38. Adjustable bracket lock 416 may be rotated clockwise to loosen or counterclockwise to lock the support, thus enabling the user to adjust the desired angle of adjustable bracket 415. Referring to FIG. 74, a non-adjustable support bracket 421, formed, e.g. of a continuous metal rod, has bracket support arms 423 at each end that engage the utility knife housing 420 in support arm pockets 419 on each side of blade 38. Bracket stop 422 rests against the utility knife housing 420 for support when the user applies pressure to the knife during use.

These and other implementations are within the scope of the following claims.

The invention claimed is:

1. A powered utility knife comprising:

an axially-elongated utility knife housing defining an internal cavity;

a shuttle plate assembly disposed for movement relative to the internal cavity of the utility knife housing, the shuttle plate assembly comprising;

a motor, a blade carrier, a drive assembly associated with the motor and mounted to impart effective cutting motion to the blade carrier;

an activator protruding through an extended slot defined through the utility knife housing, the activator being configured for slidable translation along the extended slot to cause lateral movement of the shuttle plate assembly within the internal cavity of the utility knife housing between a blade fully retracted position and a blade fully extended position; and a blade mounted to the blade carrier, wherein, with the shuttle plate assembly in the fully extended position, a first portion of the blade protrudes through a blade slot defined by a first end of the utility knife housing and with the shuttle plate assembly is in the fully retracted position, the blade retracted within the internal cavity of the utility knife housing;

a power source associated with the motor; and a power switch associated with the power source and the motor.

2. The powered utility knife of claim 1, wherein the power source at least extends within the utility knife housing at a position adjacent to the shuttle plate assembly.

3. The powered utility knife of claim 1, wherein the power switch is exposed at an outer surface of the utility knife housing and provides an electrical connection between the power source and the motor.

4. The powered utility knife of claim 1, wherein the drive assembly comprises a gear drive connecting the motor to the blade carrier and configured to convert a rotational output from the motor to a reciprocating motion acting on the blade carrier.

5. The powered utility knife of claim 4, wherein the gear drive comprises:

a worm gear associated with a drive shaft of the motor through a bearing and driven by the motor;

a cam gear driven by the worm gear and rotatably connected to the shuttle plate assembly; and a cam arm driven by the cam gear, a first end of the cam arm being rotatably connected to the cam gear and a second end of the cam arm, opposite the first end, is connected to the blade carrier.

6. The powered utility knife of claim 1, wherein the power source comprises a direct current power supply.

7. The powered utility knife of claim 6, wherein the direct current power supply comprises a battery.

8. The powered utility knife according to claim 7, wherein the utility knife housing defines a battery compartment configured to receive the battery.

9. The powered utility knife according to claim 8, wherein the battery compartment includes a plurality of electrical contacts, in electrical connection with the power switch and the motor, configured to engage corresponding contacts on the battery.

10. The powered utility according to claim 8, wherein the battery cartridge is detachably engaged with the utility knife housing.

11. The powered utility knife of claim 1, wherein the power source comprises an alternating current power supply.

12. The powered utility knife of claim 1, further comprising a blade access port defined in the outer surface of the utility knife housing, the access port being configured to provide access to the internal cavity for removal and replacement of the blade.

13. The powered utility knife of claim 1, further comprising a limit switch providing an electrical connection between the power source and the power switch, and disposed for engagement by the shuttle plate assembly when the activator is placed in fully retracted position.

14. The powered utility knife according to claim 13, wherein the limit switch is mounted within the internal cavity.

15. The powered utility knife according to claim 1, wherein the blade carrier further comprises a blade loading assist element protruding outwardly from the blade carrier and is configured for releasable engagement with a corresponding loading assist aperture defined by the blade.

16. The powered utility knife according to claim 1, wherein the blade carrier further comprises an upper blade protrusion extending outwardly from the blade carrier and configured for releasable engagement with a corresponding engagement notch defined by a first edge of the blade.

17. The powered utility knife according to claim 1, wherein the blade carrier further comprises a lower blade protrusion extending outwardly from the carrier and configured for releasable engagement with a corresponding engagement hole defined by the blade.

18. A powered utility knife comprising:

a utility knife housing defining a handle surface and an internal cavity;

a shuttle plate assembly located within the internal cavity of the handle, wherein a first surface of a shuttle plate is at least closely associated with a first interior wall of the handle, the shuttle plate assembly comprising;

a motor mounted to a second surface of the shuttle plate, opposite the first surface of the shuttle plate, a blade carrier having a first surface in sliding engagement with the second surface of the shuttle plate, the first surface of the blade carrier defining a recess housing a support spring having a first end engaged with the first surface of the blade carrier and a second end engaged with a distal surface of a blade support, the blade support protruding through a corresponding aperture defined by the blade carrier and extending outwardly from a second surface of the blade carrier, opposite the first surface of the blade carrier;

an activator being configured to cause movement of the shuttle plate assembly within the internal cavity of the utility knife housing a drive assembly associated with the motor and mounted to impart effective cutting motion to the blade carrier; and a blade mounted to the blade carrier, the blade defining a loading assist aperture configured for releasable engagement with the blade support, a first portion of the blade protruding through a blade slot defined by a first end of the handle;

a blade release button adjacent to a proximal surface of the blade support, opposite the distal surface, and having a first end configured for releasable engagement with the blade support and a second end protruding through a corresponding hole defined by the utility knife housing to extend outwardly from the handle surface, depression of the blade release button at the outer surface of the handle disengaging the blade support from the blade for removal of the blade via the blade slot;

a power source in connection with the motor; and a power switch in connection with the power source and the motor.

19. The powered utility knife of claim 18, wherein the drive assembly comprises a gear drive connecting the motor to the blade carrier and configured to convert a rotational output from the motor to a reciprocating motion acting on the blade carrier.

20. A powered utility knife comprising:

a utility knife housing defining a handle surface and an internal cavity;

a shuttle plate assembly disposed for movement relative to the internal cavity of the utility knife housing, with a first surface in sliding engagement with an interior wall of the utility knife handle, the shuttle plate assembly comprising;

a motor mounted to a second surface of the shuttle plate assembly, opposite the first surface;

a blade carrier having a first surface in sliding engagement with the second surface of the shuttle plate assembly and adjacent to the motor;

a drive assembly associated with the motor and mounted to impart effective cutting motion to the blade carrier;

an activator located at a first edge of the shuttle plate and protruding through an extended slot defined in the handle surface, the activator configured for slidable translation along the extended slot for lateral movement of the shuttle plate assembly within the internal cavity between a fully retracted position and a fully extended position; and a blade mounted to the blade carrier, wherein, with the shuttle plate assembly is in the fully extended position a first portion of the blade protrudes through a blade slot defined by a first end of the utility knife housing and, with the shuttle plate assembly in the fully retracted position, the blade is retracted within the internal cavity of the utility knife housing, a first portion of the blade performing cutting action and, upon rotation of the blade 180 degrees in the blade carrier, a second portion of the blade performing cutting action.

21. The powered utility knife of claim 20, wherein the drive assembly comprises a gear drive connecting the motor to the blade carrier and configured to convert a rotational output from the motor to a reciprocating motion acting on the blade carrier.

* * * * *